US007120366B2

(12) United States Patent
Onodera et al.

(10) Patent No.: US 7,120,366 B2
(45) Date of Patent: Oct. 10, 2006

(54) IMAGE FORMING APPARATUS AND CONTROL METHOD THEREOF

(75) Inventors: Shinichi Onodera, Tokyo (JP); Keizo Isemura, Koganei (JP); Ichiro Sasaki, Toride (JP); Naohisa Nagata, Moriya (JP); Akinobu Nishikata, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/042,169

(22) Filed: Jan. 26, 2005

(65) Prior Publication Data

US 2005/0169649 A1 Aug. 4, 2005

(30) Foreign Application Priority Data

Jan. 29, 2004 (JP) ..... 2004-021317
Mar. 25, 2004 (JP) ..... 2004-090058

(51) Int. Cl.
*G03G 21/12* (2006.01)

(52) U.S. Cl. ..... 399/35; 399/71; 399/123; 399/358; 399/360

(58) Field of Classification Search ..... 399/35, 399/71, 123, 358, 360
See application file for complete search history.

(56) References Cited

U.S. PATENT DOCUMENTS 5,237,373 A * 8/1993 Aimoto et al. ..... 399/35
5,260,750 A * 11/1993 Ishida et al. ..... 399/359
5,493,382 A * 2/1996 Takagaki et al. ..... 399/359
5,581,342 A 12/1996 Yamauchi ..... 355/298
5,634,172 A 5/1997 Manabe ..... 399/35
6,226,490 B1 * 5/2001 Fujita et al. ..... 399/359
6,587,661 B1 * 7/2003 Shimmura et al. ..... 399/35
2002/0150405 A1 10/2002 Tanisawa et al. ..... 399/120
2006/0013601 A1 * 1/2006 Stahuber ..... 399/35

FOREIGN PATENT DOCUMENTS

JP 07271259 A * 10/1995
JP 10-186987 7/1998

OTHER PUBLICATIONS

Patent Abstracts of Japan, Publication No. 10-186987, Jul. 14, 1998.

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

An image forming apparatus which conveys waste toner includes a buffer portion 101 capable of temporarily containing the waste toner and a waste toner container 102 capable of containing the waste toner and a waste toner container 102 capable of containing the waste toner. The waste toner is dominantly contained in the waste toner container 102 compared with the buffer portion 101. When the waste toner container 102 is filled with the waste toner, the waste toner can be contained in the buffer portion 101. An engine controller 120 detects whether the buffer portion 101 is filled with the waste toner 112 or not through a buffer portion waste toner full state detection sensor 105. When the buffer portion 101 is filled with the waste toner 112, the engine controller controls so that a conveyance operation by a first waste toner pipe 103 and an image forming operation are stopped.

8 Claims, 19 Drawing Sheets

(a)

(b)

| SENSER OUTPUT LOGIC | LOADING TRAY OPEN / CLOSE DETECTION SENSOR S1 | WASTE TONER CONTAINER DETECTION SENSOR S2 | WASTE TONER CONTAINER FULL STATE DETECTION SENSOR 107 | BUFFER PORTION WASTE TONER EMPTY STATE SENSOR 106 | BUFFER PORTION WASTE TONER FULL STATE SENSOR 105 |
|---|---|---|---|---|---|
| 0 | CLOSE | PRESENCE | NOT FULL | NOT EMPTY | NOT FULL |
| 1 | OPEN | ABSENCE | FULL | EMPTY | FULL |

FIG.17

IMAGE FORMING APPARATUS AND CONTROL METHOD THEREOF

FIELD OF THE INVENTION AND RELATED ART

The present invention relates to an image forming apparatus, such as a copying machine, a printer or the like, particularly an image forming apparatus in which toner used or to be used for image formation is fed toward a toner container.

In an image forming apparatus, such as a copying machine or a printer, for forming an image according to electrophotographic process, a toner image formed on an image bearing member such as a photosensitive drum or the like is transferred onto a sheet and then is fixed on the sheet by a fixing apparatus, such as a hot fixing device or a pressure fixing device, to obtain an image.

Heretofore, in such an image forming apparatus, toner remaining on the image bearing member after the toner image is transferred onto the sheet is recovered as waste toner by a cleaner, and the waste toner is conveyed to a waste toner container through a conveyance path such as a waste toner conveyance pipe. Then, when the waste toner contained in the waste toner container becomes full, replacement of the waste toner container is performed. With respect to timing of the waste toner container replacement, notification is provided in the case where a filled (full) state of the waste toner in the waste toner container is detected by weight detection or an optical sensor or the case where the waste toner full state is predicted by use of a sheet counter.

Ordinarily, it is necessary to stop such an operation that the waste toner is conveyed into the waste toner container in order to prevent overflow of waste toner from the waste toner container so as not to contaminate the inside of the image forming apparatus when the waste toner in the waste toner container becomes full or in order to prevent leakage of waste toner from a discharge opening for waste toner conveyance so as not to contaminate the inside of the image forming apparatus at the time of replacing the waste toner container. Further, a conveyance operation of the waste toner is performed in synchronism with an image forming operation, so that the image forming operation is also required to be stopped together with the conveyance operation of the waste toner.

Accordingly, in the case where the waste toner container is placed in a full state during a print job, the print job has been required to be stopped before the waste toner in the waste toner container become full when the waste toner container is replaced.

In order to solve such a problem, e.g., Japanese Laid-Open Patent Application No. Hei 10-186987 has disclosed such a technique that a buffer portion for accumulating waste toner is provided in a conveyance path for conveying the waste toner and an accumulation capacity of the waste toner at the buffer portion is set to be larger than a maximum of the amount of waste toner recovered by an image forming operation in one print job, whereby it becomes possible to continue the print job and replace the waste toner container during the print job after the waste toner in the waste toner container becomes full.

However, in such a technique, when the waste toner container is replaced or after the waste toner container is placed in a full state during the print job, conveyance of the waste toner to the waste toner container is stopped and the print job is continued while accumulating the waste toner at the buffer portion. For this reason, in an image forming apparatus such as a digital printer which continuously processes a plurality of print jobs, an amount of waste toner in the buffer portion exceeds the set accumulation capacity, so that the waste toner overflows the buffer portion. As a result, there has arisen such a problem that the buffer portion is blocked with the waste toner.

Further, in the above described technique, when the waste toner container is filled with the waste toner, notification of filled (full) state of the waste toner container is provided to a user, whereby the user is urged to replace the waste toner container. However, in the case where the image forming apparatus is used in such a manner that a user who directly operates the image forming apparatus or an apparatus administrator such as a supervisor is not employed, a plurality of print jobs are continuously performed without replacing the waste toner container even after the notification of the full state of the waste toner container. As a result, an amount of waste toner in the buffer portion exceeds the set accumulation capacity, so that the waste toner overflows the buffer portion to block the buffer portion.

SUMMARY OF THE INVENTION

The present invention has accomplished in order to solve the above described problems.

An object of the present invention is to provide an image forming apparatus capable of continuously performing a plurality of image forming operations without causing overflow of waste toner even at the time of replacing a waste toner container and after the waste toner container is filled with the waste toner.

According to an aspect of the present invention, there is provided an image forming apparatus, comprising:

image forming means, for forming an image on a recording medium with toner, having a discharge portion for permitting discharge of toner, a first container capable of containing the toner conveyed from the discharge portion, a second container capable of containing the toner conveyed from the discharge portion, stop means for stopping conveyance of the toner from the discharge portion to the second container, and detection means for detecting an amount of the toner contained in the first container, wherein when the conveyance of the toner from the discharge portion to the second container is stopped, the first container is capable of containing the toner and on the basis of a detection result of the detection means, a determination as to whether image formation is performed or not is made.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 17 is a table showing output logic of detection signals from respective sensors.

DETAILED DESCRIPTION OF THE PREFERRED EMBODIMENTS

Hereinbelow, preferred embodiments of the present invention will be described more specifically with reference to the drawings.

(General Structure)

With reference to schematic views shown in FIGS. 1 and 2, a structure of a buffer portion for temporarily storing waste toner after being subjected to a development through an image forming process according to electrophotography, a structure of a waste toner container for accommodating the waste toner conveyed via the buffer portion, and conveyance of the waste toner will be described.

Figure 1:
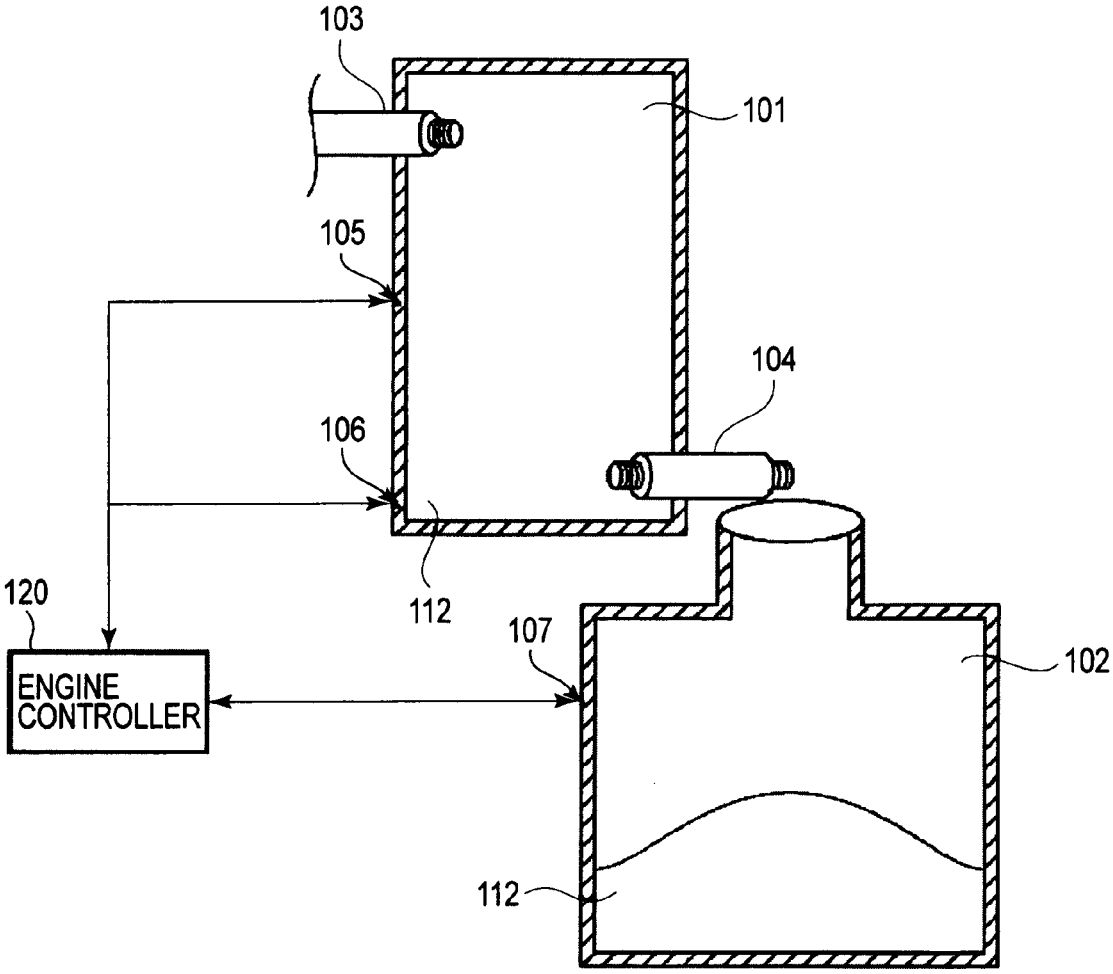
FIGS. 1 and 2 are schematic views each showing a structure of a buffer portion and a waste toner container which accommodate waste toner.

FIG. 1 is a schematic view showing a structure of a buffer portion as a first container for accommodating the waste toner and a structure of a waste toner container as a second container.

Referring to FIG. 1, a buffer portion 101 accumulates waste toner 112 which is discharged from a cleaner, as a cleaning means, which is a part of image forming means. In a cleaner container, a discharge portion (381 shown in FIG. 3) for discharging toner toward the waste toner container 102. The waste toner container 102 accumulates the waste toner 112 conveyed from the buffer portion 102 accumulates the waste toner 112 conveyed from the buffer portion 101. A first waste toner conveyance pipe 103 is a first conveyance means is a conveyance path for conveying the waste toner 112 discharged from the cleaner to the buffer portion 101. A second waste toner pipe 104 as a second conveyance means is a conveyance path for carrying the waste toner 112 from the buffer portion 101 to the waste toner container 102.

In this embodiment, a toner conveyance ability per unit time of the second conveyance means is set to be larger than that of the first conveyance means, whereby in the case of driving both of the first and second conveyance means, the waste toner is not accumulated at the buffer portion. In other words, the waste toner is dominantly accommodated in the waste toner container compared with the buffer portion. By doing so, it is not necessary to stop an image forming operation since there is a space capable of accommodating the waste toner at the buffer portion when the waste toner container is filled with the waste toner. As described above, in this embodiment, the conveyance ability of the second conveyance means is larger than that of the first conveyance means.

Incidentally, inside the first and second waste toner pipes 103 and 104, screws drive by unshown drive systems are provided, respectively. The respectively, screws are independently rotated by control of an engine controller, as described later, after the image forming process is performed, whereby the waste toner 112 is conveyed from the cleaner to the buffer portion 101 and conveyed from the buffer portion 101 to the waste toner container 102.

As detection means for detecting toner amount in the buffer portion, two sensors capable of detecting a first toner amount and second toner amount are used. More specifically, a buffer portion waste toner full state detection sensor 105 detects whether the waste toner 112 in the buffer portion 101 becomes full or is close to a full state or not (first detection level). A buffer portion waste toner empty state detection sensor 106 detects whether the waste toner 112 in the buffer portion 101 becomes empty or not (second developing level). With respect to the waste toner container 102, a waste toner container full state detection sensor 102 becomes full or is close to a full state or not.

An engine controller (engine control portion) 120 includes a computing unit such as a CPU (central processing unit) or an MPU (microprocessing unit), a ROM (read-only memory) in which a program for the computing unit is stored, and a RAM (random-access memory) in which operation areas and various tables, which are used at the time of performing control, are defined. Further, the engine controller 120 contacts the image forming process on the basis of image forming instructions from a controller as described later and inputs signals from the respective sensors, thus performing waste toner full state detection control for the buffer portion 101 and the waste toner container 102 (details of which will be described later).

Figure 2:
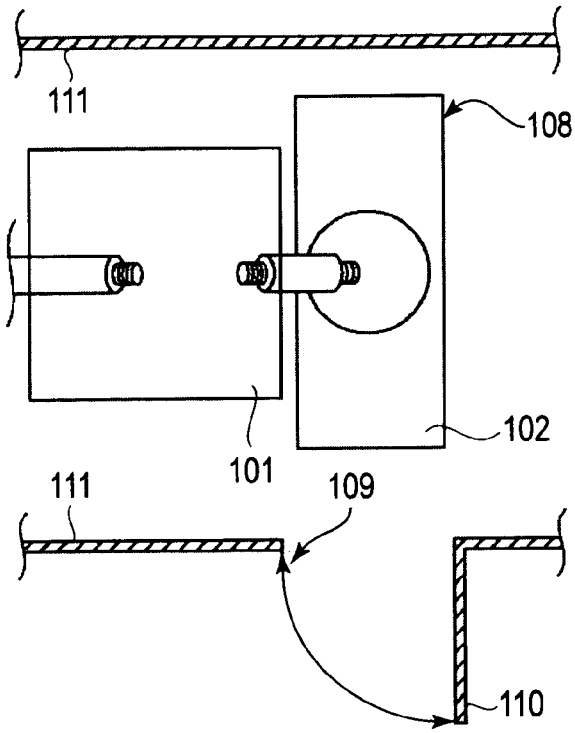

In FIG. 2, a waste toner container presence/absence detection sensor 108 detects whether the waste toner container 102 is loaded in the apparatus main assembly or not. A door open/close sensor 109 detects an open/close state of a door 110 for removing the waste toner container 102 from the apparatus main assembly. A reference numeral 111 represents a wall surface of the apparatus main assembly.

Here, with reference to FIG. 3, a structure and an operation of an image forming portion (engine) as an image forming means for performing an image formation process on the basis of image formation instructions from an unshown controller will be described.

Figure 3:
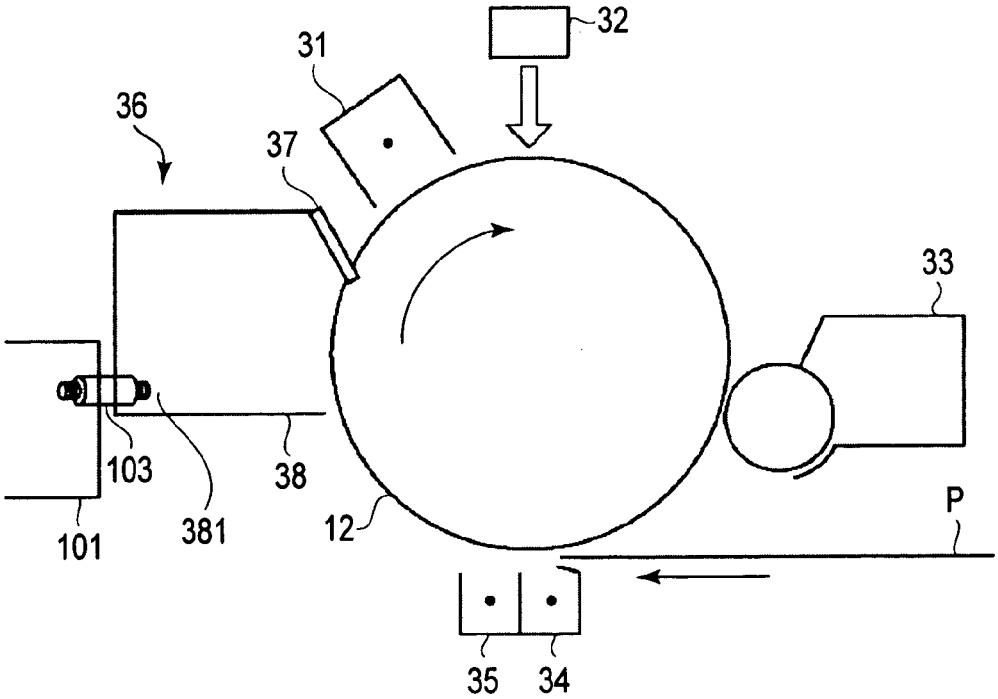
FIG. 3 is a schematic view showing a structure of an image forming portion (engine) for performing an image forming process on the basis of image forming instructions from a controller.

Referring to FIG. 3, a photosensitive drum 12 as an image bearing member such as an electro-photographic photosensitive member is rotated in a direction of an arrow indicated therein. Further, a surface of the photosensitive drum 12 is exposed to light by a charger 31 and thereon, an electrostatic latent image is formed by laser light which is modulated by a laser unit 32 on the basis of image data outputted from the unshown controller. The electrostatic latent image is visualized with developer such as toner by a developing device 33 to provide a developed image. The developed image is transferred onto a recording sheet P such as paper by a transfer device 34, and the recording sheet P is separated from the photosensitive drum 12 by a separation device 35. Then, the recording sheet P is conveyed to a fixing device (not shown) by which the developed image is fixed on the recording sheet P.

On the other hand, residual toner which remains on the photosensitive drum 12 without being transferred onto the recording sheet P is removed by a cleaning member 37 such as a cleaning blade or a cleaning roller and is accumulated as waste toner in a cleaner container 38 of a cleaner 36. The waste toner discharged out of the cleaner 36 is conveyed to the buffer portion 101 by a screw disposed in the first waste 13 toner conveyance pipe 103.

Figure 4:
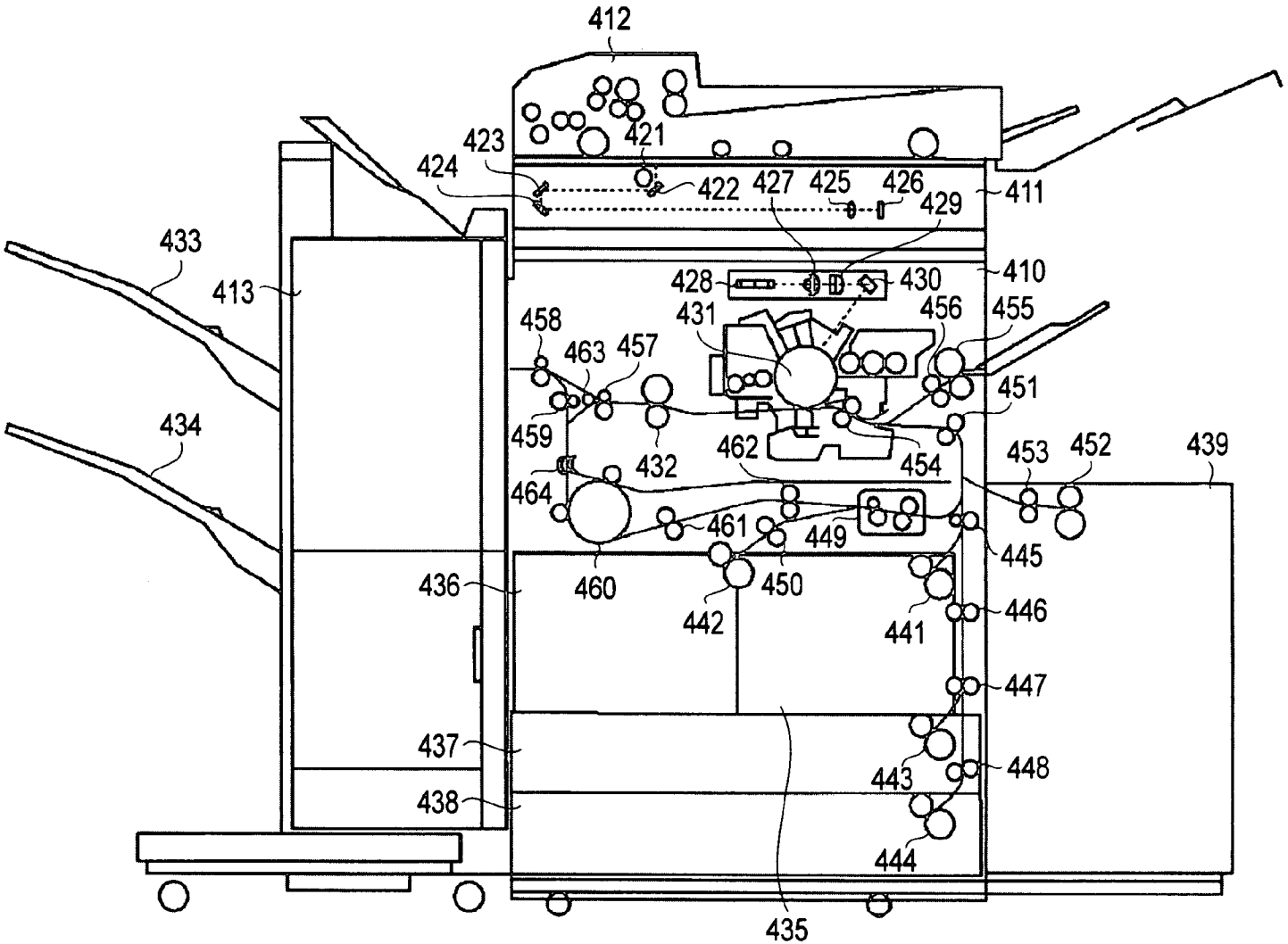
FIG. 4 is a side cross-sectional view showing a structure of an image forming apparatus according to an embodiment of the present invention.

FIG. 4 is a side cross-sectional view showing a structure of the image forming apparatus in this embodiment.

As shown in FIG. 4, the image forming apparatus of this embodiment includes a main assembly image output portion 410 which is an apparatus for outputting an original image formed on a recording sheet (paper); a main assembly image input portion 411 which is an apparatus for reading image data from an original; an automatic sheet feeding apparatus 412 mounted on an upper portion of the main assembly image input portion 411; and a sorter 413 for discharging copied sheets out of the main assembly output portion 410 while sorting the sheets into a plurality of bins.

Incidentally, the image forming apparatus shown in FIG. 4 has a printer function and a copying function and is a digital copying machine for forming an image based on image information from an external equipment such as a controller or the main assembly image input portion.

Here, in the case where an image is read from an original, the image is read as image data pixelated by a CCD (charge-control device) of the main assembly input portion 411, subjected to a necessary image processing, and once stored in an image memory. Then, the image data are transferred to the main assembly image output portion 410, where an image is reproduced and copied on a recording sheet.

The main assembly image input portion 411 is provided with a light source 421 which scans an original placed on an original supporting plate at an upper surface of the input portion while irradiating the original with light. The light source 421 is supplied with a driving force from an unshown optical system motor to be reciprocated in a horizontal direction. Light emitted from the light source 421 is reflected by the original to provide an optical image. The optical image is transmitted to a CCD 425. These mirrors 422, 423 and 424 are integrally moved with the light source 421. The CCD 426 is constituted by an element which converts the light into an electric signal. The optical image which has been transmitted by the action of the element is converted into an electric signal and further converted into a digital signal (image signal).

Next, the image data read from the original are subjected to various correction processings and image processing desired by a user and stored in a large-capacity image memory. Respective adjusting values in these image processings are stored in a backup storing apparatus.

On the other hand, the main assembly output portion 410 reads the image data stored in the image memory and reconverts the digital signal into an analog signal, which is further amplified by an unshown exposure controller to provide an appropriate output value and is converted into an optical signal by an optical irradiation portion 427. The optical signal is transmitted onto a photosensitive drum 431 (12 in FIG. 3) through a scanner 428, a lens 429, and a mirror 430 to form an electrostatic latent image. The latent image is developed with toner to provide a toner image, which is transferred onto a recording sheet conveyed in the apparatus main assembly. Further, the toner (image) is fixed on the recording sheet by a fixing roller 432 to be recorded as image data and is sent to a sorter 413. The respective adjusting values in the main assembly image output portion 410 are stored in a backup storing apparatus.

The sorter 413 is disposed on the left side of the main assembly image output portion 410 and effects such a treatment that recording sheets outputted from the main assembly image output portion 410 are sorted into an upper output tray 433 and a lower output tray 434. These output trays 433 and 434 are controlled by the engine controller 120 and the outputted recording sheets are outputted on any of the upper and lower output trays in accordance with instructions from the controller.

As paper supply (feeding) trays, a right deck 435, a left deck 436, an upper cassette 437, and a lower cassette 438 are disposed at a lower portion of the apparatus main assembly, and a side deck 439 is disposed on the right side of the apparatus main assembly. Incidentally, the decks disposed at the lower portion of the apparatus main assembly can hold approximately 1500 sheets. The cassettes can hold approximately 550 sheets, and the side deck can hold approximately 3500 sheets. A recording sheet is conveyed from the paper supply tray 435 to 439 in accordance with instructions from the engine controller 120 to be subjected to image output thereon.

On the paper supply trays 435 to 439, papers are set by an operator so as to have a predetermined paper size and direction. These setting data are stored in the backup storing apparatus.

Further, on the right side of the main assembly image output portion 410, a manual paper feed tray 440 capable of feeding a small number of copying sheets of arbitrary types relatively easily by the operator is disposed. The manual paper feed tray 440 is also used in the case of employing special recording sheets such as an OHP sheet, thick paper, a postcard-sized paper, or the like.

Paper feeding rollers 441, 442, 443, 444 and 452 are constituted by three types of rollers including unshown pickup rollers for picking up the recording sheet, (upper) conveyance rollers for performing sheet conveyance, and (lower) separation rollers for separating stacked sheets. The paper feeding rollers are driven by stepping motors, respectively. A paper feeding operation is performed in such a manner that sheets are supplied to the right deck by a right deck motor, to the left deck by a left deck motor, and to the upper and lower cassettes by driving a cassette paper supply motor in a normal or reverse direction to switch the upper and lower cassettes. To the side deck, sheets are supplied by actuating a side deck motor (stepping motor) connected with a side deck drawing roller 453 through a clutch.

Next, conveyance rollers will be described.

A registration roller 454 is driven by a drum motor through a clutch to convey the recording sheet. A multi-paper feeding roller 455, a multi-drawing roller 456, and a left deck-driving roller 450 are driven by a main motor through a clutch to convey the recording sheet. A fixing roller 432 and an inner paper output roller 457 are driven by a fixing motor. A lower vertical path roller 448, an intermediary vertical path roller 447 are driven by a lower vertical path motor (stepping motor). An upper vertical path roller 446 is driven by an upper vertical path motor (stopping motor) A vertical path conveyance roller 445 and a double-sided conveyance roller 449 are driven by a vertical path double-sided conveyance motor (stepping motor). A pre-registration roller 451 is driven by a pre-registration motor (stepping motor). An outer paper output roller 458 is driven by an outer paper output motor (stepping motor). A reverse roller 460 is driven by a reverse motor (stepping motor). A right double-sided conveyance roller 461 and a left double-sided conveyance roller 462 are driven by a left double-sided conveyance motor (stepping motor) and a right double-sided conveyance motor (stepping motor), respectively.

(Embodiment 1)

In the above described image forming apparatus, first, the waste toner 112 discharged from the cleaner 36 via the first waste toner pipe 103 is accumulated in the buffer portion 101, and while conveying the waste toner 112 to the waste toner container 103 via the second waste toner pipe 104, determination is made as to whether the buffer portion 101 is filled or not with the waste toner 112 by the buffer portion waste toner full state detection sensor (first detection sensor) 105, not the waste toner container full state detection sensor (second detection sensor) 107. In the case where the buffer portion 101 is placed in a full state, the engine controller 120 effects control so that image formation is stopped. Such a detection control of the buffer portion 101 filled with the waste toner 112 by the engine controller 120 will be described.

Figure 5:
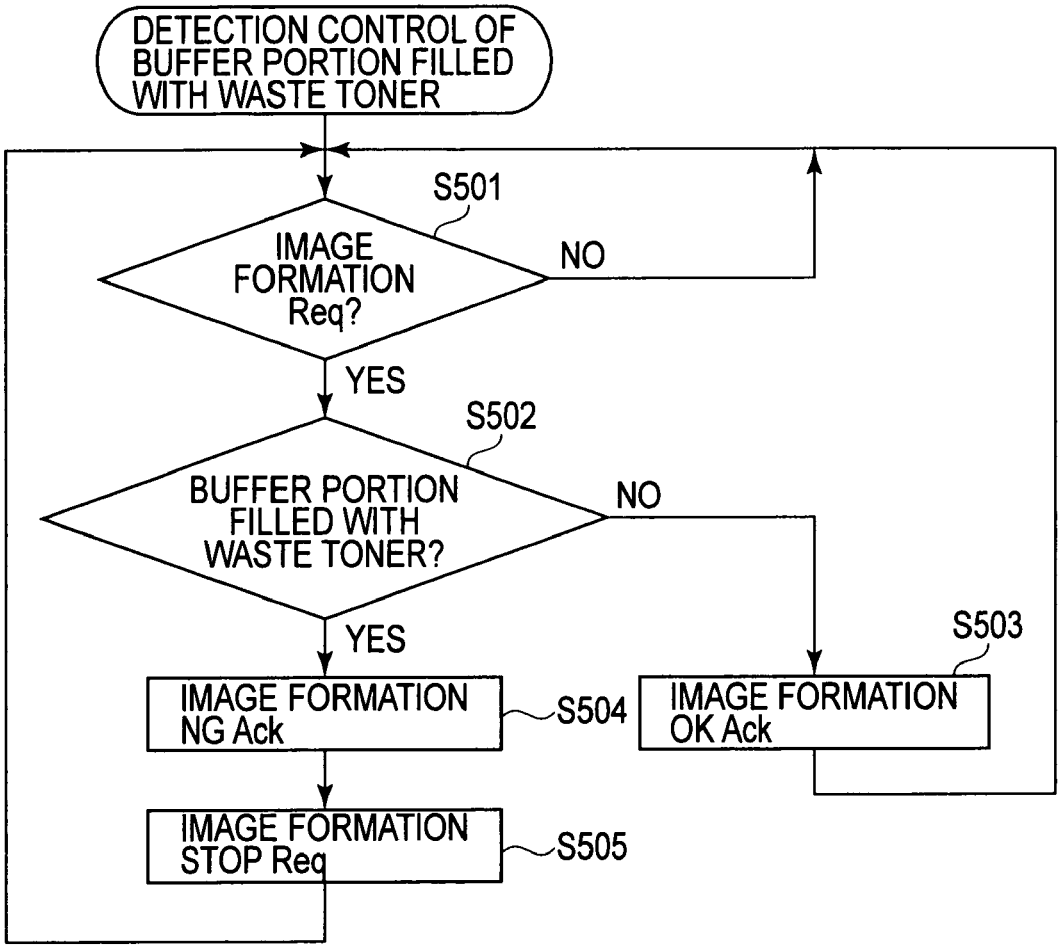
FIGS. 5, 6, and 7 are flowcharts showing detection control of buffer portion filled with waste toner in Embodiments 1, 2 and 3, respectively.

FIG. 5 is a flowchart showing the detection control of buffer portion filled with waste toner in this embodiment.

Referring to FIG. 5, first, in a step S501, a determination is made as to whether there is an image forming request from the controller or not. In this step, when there is no image formation request, the control (operation) enters a loop until the image formation request is made. Incidentally, in this embodiment, the loop is executed but it is also possible to effect waiting depending on a software configuration.

Further, when there is the image formation request, the control goes to a step S502 in which a determination whether the waste toner in the buffer portion 101 is in a full state or not is made on the basis of a signal from the buffer portion waste toner full state detection sensor 105. When the signal is not a signal for indicating the full state, the control goes to a step S503 in which acknowledgement of image formation is made with respect to the request from the controller. Thereafter, the control is returned to the step S501 in order to prepare for a next image formation request.

On the other hand, in the step S502, when the signal is a full state indication signal, the control goes to a step S504 in which an image formation disable response to the controller is made since the buffer portion 101 has already been filled with the waste toner. Then, in a step S505, an image formation stop request to the controller is made.

Incidentally, there is also the case where the processing in the step S505 is not particularly required. More specifically, in this case, it is also possible to stop the image formation by the controller in accordance with the image formation disable response in the step S504.

Further, the engine controller 120 effects control of conveyance of the waste toner 112 by the first waste toner pipe 103 on the basis of the buffer portion waste toner full state detection sensor 105. More specifically, in the case where the signal from the buffer portion waste toner full state detection sensor indicates the full state, the screw of the first waste toner pipe 103 is stopped to terminate the conveyance of waste toner from the cleaner container 38 to the buffer portion 101. Thereafter, in the case where the signal from the buffer portion waste toner full state detection sensor does not indicate the full state due to the conveyance of waste toner from the buffer portion 101 to the waste toner container 102, the screw of the first waste toner pipe 103 is driven again to start conveyance of the waste toner 112 from the cleaner container 38 to the buffer portion 101.

On the other hand, conveyance control of the waste toner 112 by the second waste toner pipe 104 is performed in an ordinary manner. More specifically, in the case where the waste toner 112 in the waste toner container 102 is placed in a state close to the full state or the case where there is no waste toner 112 in the buffer portion 101, the screw of the second waste toner pipe 104 is stopped by the engine controller as a stop means to terminate conveyance of the waste toner from the buffer portion 101 to the waste toner container 102. Then, after the waste toner container 102 is replaced, the control is effected so as to start again the waste toner container. Details of the control will be described in Embodiment 4.

As described above, according to Embodiment 1, by detecting whether or not the buffer portion 101 is filled with the waste toner 112 with use of the buffer portion waste toner full state detection sensor 105, not the waste toner container full state detection sensor 107, it is possible to continue the image formation even when the waste toner container 102 is filled with the waste toner. Further, it is also possible to effect the image formation even when the waste toner container 102 is absent for replacement.

Further, by using the sensor, for detecting whether the buffer portion 101 is filled or not with the waste toner such as the buffer portion waste toner full state detection sensor 105, it is possible to terminate the waste toner container from the cleaner 36 to the buffer portion 101 and the image formation. As a result, it is possible to obviate such a possibility that overflow of the waste toner in the case of continuing the image formation is caused to occur as in the conventional image forming apparatus.

(Embodiment 2)

Next, in this embodiment, determination is made as to whether the waste toner 112 in the buffer portion 101 is placed in a state close to the full state or not on the basis of a detection signal from the buffer portion waste toner full state detection sensor 105. After the waste toner 112 is placed in such a state, when image formation on a predetermined number of sheets is effected, the image formation is stopped. Such a detection control of the buffer portion 101 filled with the waste toner 112 in this embodiment will be described.

In this embodiment, the buffer portion waste toner full state detection sensor 105 detects whether the waste toner in the buffer portion 101 is in a state close to the full state or not.

Figure 6:
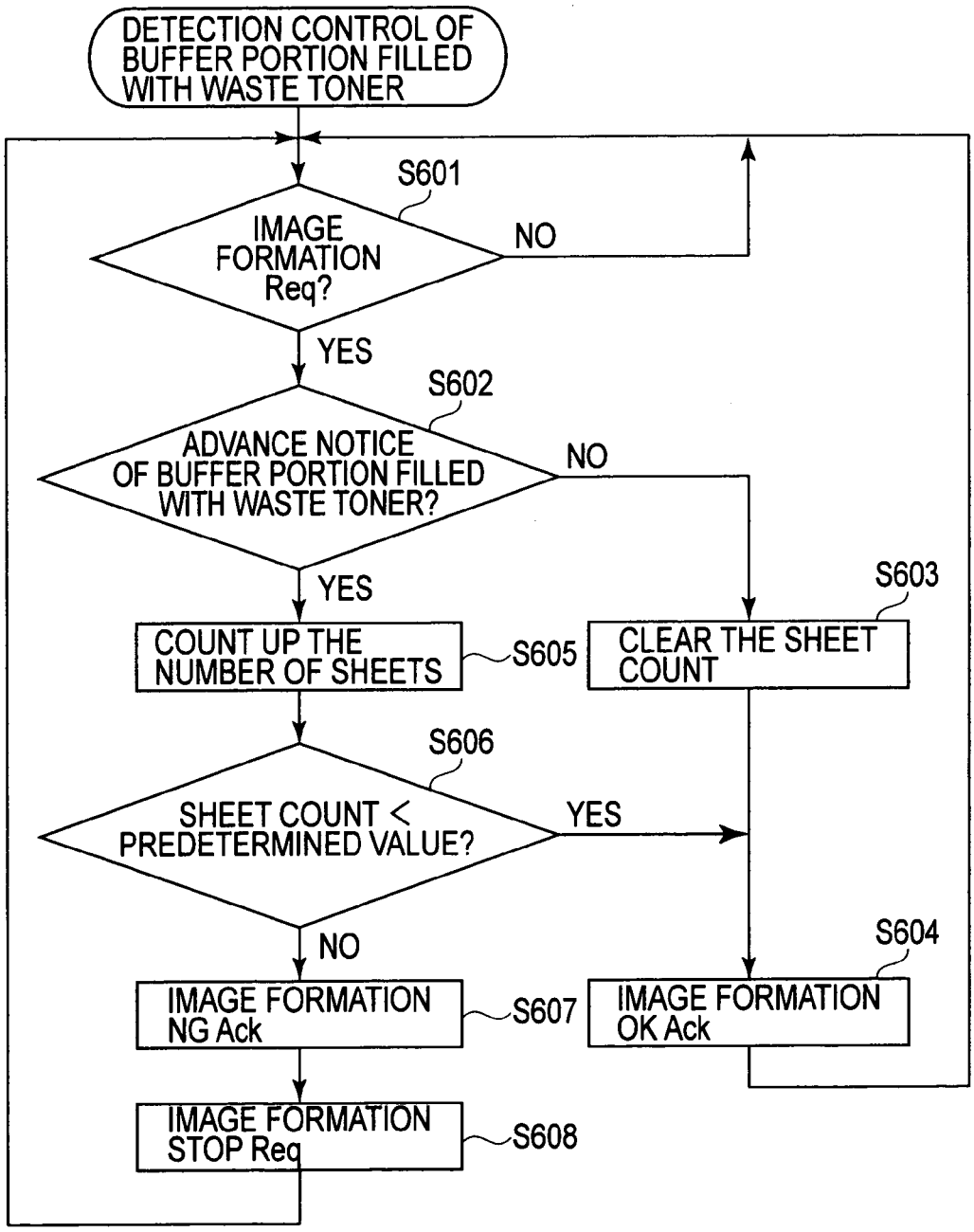

FIG. 6 is a flowchart showing the detection control of buffer portion filled with waste toner in this embodiment.

Referring to FIG. 6, first, in a step S601, a determination is made as to whether there is an image forming request from the controller or not. In this step, when there is no image formation request, the control (operation) enters a loop until the image formation request is made.

Further, when there is the image formation request, the control goes to a step S602 in which a determination whether the waste toner in the buffer portion 101 is in a full state or not is made on the basis of a signal from the buffer portion waste toner full state detection sensor 105. When the signal is not a signal for indicating the state close to the full state, the control goes to a step S603 in which a value of a sheet counter for counting the number of sheet subjected to this embodiment is cleaned, and in a step S604 in which acknowledgement of image formation is made with respect to the request from the controller. Thereafter, the control is returned to the step S601 in order to prepare for a next image formation request.

On the other hand, in the step S602, when the signal a signal indicating the state close to the full state, the control goes to a step S605 in which the value of the sheet counter is increased by the number of sheets designated by the controller. Next, in a step S606, the increased value of the sheet counter is compared with a (predetermined) value which has been determined in advance. When the increased value is less than the predetermined value, the control goes to the above described step S604 but when the increased value is not less than the predetermined value, the control goes to a step S607 in which an image formation stop request to the controller is made.

Incidentally, the above described predetermined value may be determined empirically on the basis of density information since an amount of toner consumption is different depending on the number of original sheets subjected to image formation by the user and image attributes (character, photograph, etc.)

Further, in this embodiment, similarly as in Embodiment 1, the engine controller 120 effects control of conveyance of the waste toner 112 by the first waste toner pipe 103 and control of conveyance of the waste toner 112 by the second waste toner pipe 104 on the basis of the buffer portion waste toner full state detection sensor 105 and the value of the sheet counter for counting the number of sheets subjected to the image formation.

As described above, according to Embodiment 2, in addition to the effects attained in Embodiment 1, it is possible to further continue the image formation.

(Embodiment 3)

In this embodiment, in addition to the control of Embodiment 2, such a control that waste toner full state advance notification to the controller is further effected in the case where the waste toner in the buffer portion 101 is first placed in a state close to the full state. Such a detection control of the buffer portion filled with the waste toner in this embodiment will be described.

Figure 7:
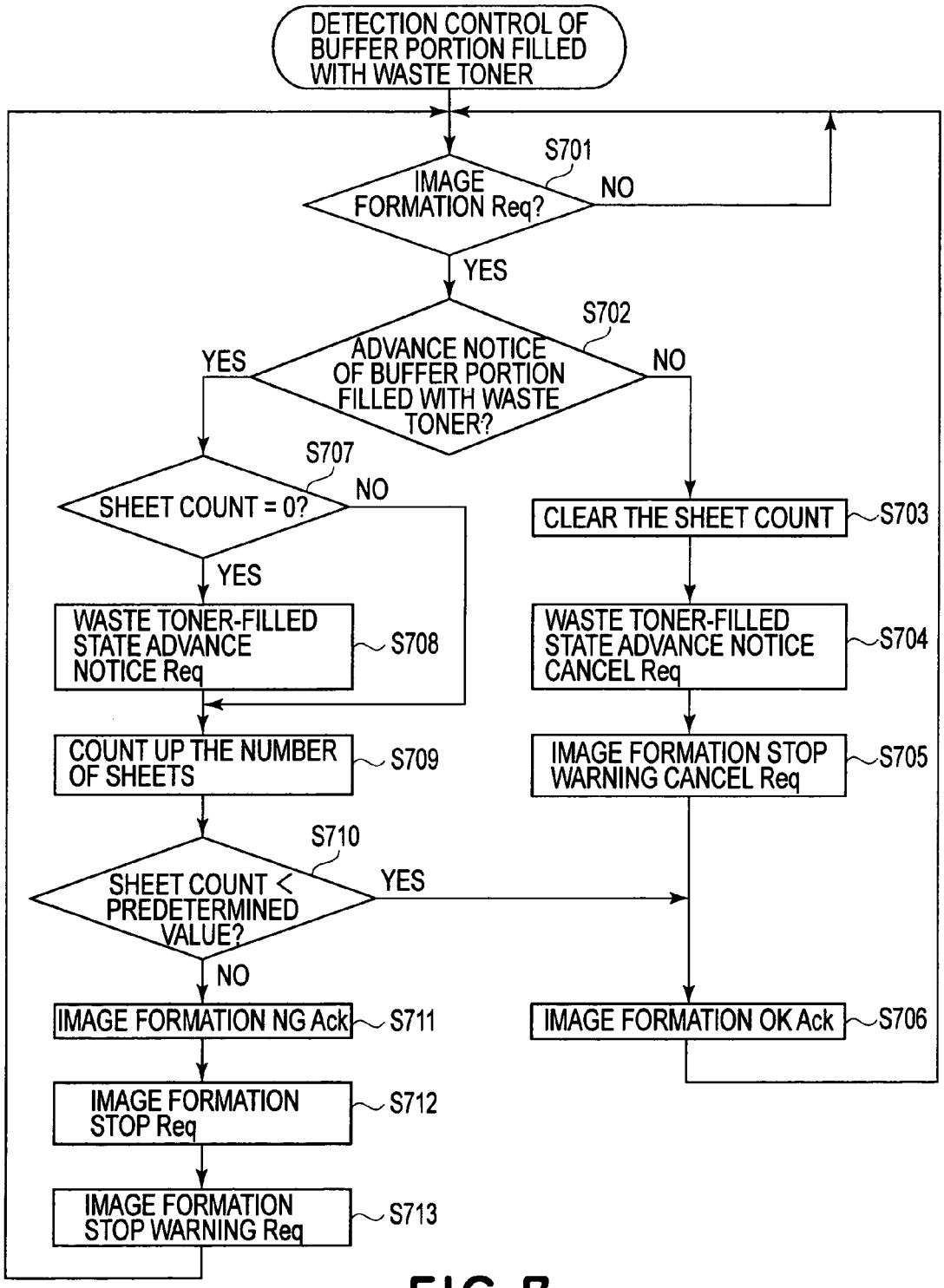

FIG. 7 is a flowchart showing the buffer portion waste toner full state detection control in this embodiment.

In this embodiment, steps S701 to S703, S706, and S709 to S712 are identical to the steps S601 to S603, S604, and S605 to S608 described in Embodiment 2 with reference to FIG. 6. Hereinbelow, only different steps will be described.

As shown in FIG. 7, when a signal from the buffer portion waste toner full state detection sensor 105 for the buffer portion 101 is not a signal indicating a state close to the full state, the control goes to a step S703 in which a value of the sheet counter for counting the number of sheets subjected to image formation is cleared and in a step S704, as a warning, a cancel request is issued to the controller in order to cancel such a warning that the waste toner is in a state close to the full state. Then, in a step S705, an image formation stop warning cancel request to the controller is made in order to cancel the image formation stop warning and then the control goes to a step S706.

On the other hand, in a step S702, when the signal is a signal indicating the state close to the full state, the control goes to a step S707 in which a trigger as to whether full state advance notification is made or not is determined by whether or not the value of the sheet counter is zero. In the case of making the full state advance notification, i.e., the case where the sheet counter value is zero, the control goes to a step S708, and in the case where the control has already entered a full state advance notification state, it goes to a step S709. In the step S708, a request is issued to the controller so as to provide the full state advance notification, and the control goes to the step S709. The subsequent steps up to the step S712 are the same as those in Embodiment 2. In a step S713, a request is issued so as to provide a image formation stop warning.

Incidentally, conveyance control of the waste toner 112 by the engine controller 120 with use of the first waste toner pipe 103 and the second waste toner pipe 104 is performed similarly as in Embodiment 2.

Here, warning display control on the side of the controller which receives the waste toner full state advance notification request and the image formation stop warning request by the above described detection control of buffer portion filled with waste toner by the engine controller will be described.

Figure 8:
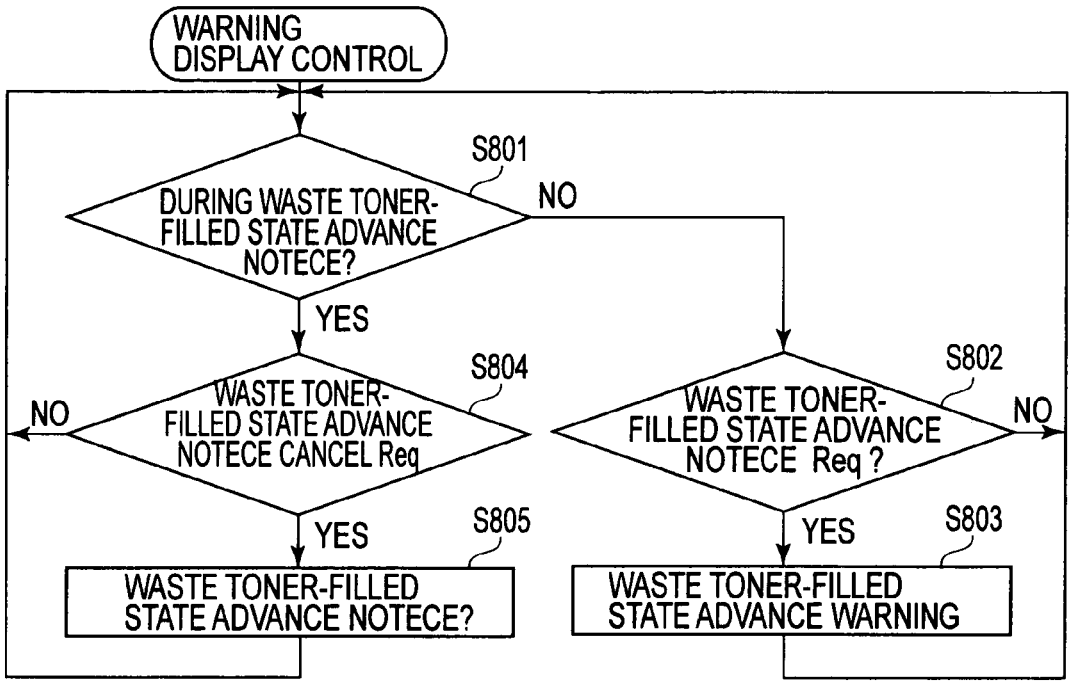
FIG. 8 is a flowchart showing waste toner-filled state warning display control in a controller.

FIG. 8 is a flowchart showing waste toner full state warning display control in the controller.

First, in a step S801, a determination is made as to whether or not a warning for providing such an advance notification that the waste toner in the buffer portion 101 is in a state close to the full state is currently displayed at a display portion of an operation panel. When the advance notification warning is not currently displayed, the control goes to a step S802 in which a determination as to whether or not the waste toner full state advance notification request is received from the above described engine controller 120 is made. When the waste toner full state advance notification request is not received, the control is returned to the step S801 but when it is received, the control goes to a step S803 in which an advance notification warning indicating that the waste toner in the buffer portion 101 is in the state close to the full state is displayed at the display portion of the operation panel and is returned to the step S801.

Further, in the step S801, in the case where the waste toner full state advance notification has already been provided, the control goes to a step S804 in which a determination is made as to whether or not the waste toner full state advance notification cancel request to received from the engine controller 120 by, e.g., replacing the waste toner container 102. When the waste toner full state advance notification cancel request is not received it is received, the control goes to a step S805 in which the warning of the waste toner full state advance notification is cancelled and is returned to the step S801.

Figure 9:
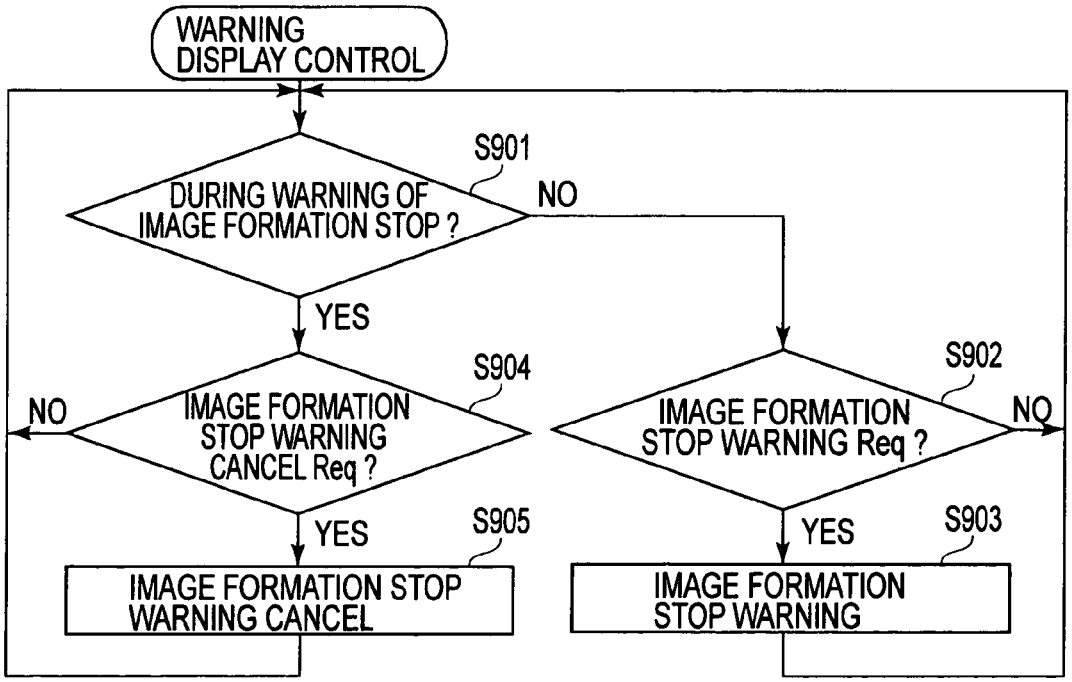
FIG. 9 is a flowchart showing image forming stop warning display control in the controller.

FIG. 9 is a flowchart showing image formation stop warning display control in the controller.

First, in a step S901, a determination is made as to whether or not such a warning that the waste toner in the buffer portion 101 is in a state close to the full state to stop the image formation is currently displayed at a display portion of an operation panel. When the warning is not currently displayed, the control goes to a step S902 in which a determination as to whether or not the image formation stop warning request is received from the above described engine controller 120 is made. When the image formation stop warning cancel request is not received, the control is returned to the step S901 but when it is received, the control goes to a step S903 in which a warning for stopping the image formation is displayed at the display portion of the operation panel and is returned to the step S901.

Further, in the step S901, in the case where the image formation stop warning has already been provided, the control goes to a step S904 in which a determination is made as to whether or not the image formation stop warning cancel request to received from the engine controller 120 by, e.g., replacing the waste toner container 102. When the image formation stop warning cancel request is not received it is received, the control goes to a step S905 in which the warning of the image formation stop is cancelled and is returned to the step S901.

Incidentally, in Embodiment 3, the control shown in FIG. 8 and the control shown in FIG. 9 are separately described but these controls may be performed successively. Further, the warning cancel may be performed not only in the case of receiving the warning cancel request from the engine controller 120 but also in such a manner that a user or a service person directly cancel the warning on the operation panel after the waste toner container is replaced.

(Modified Embodiment)

Next, a modified embodiment of Embodiment 3 in which a warning is cancelled when the waste toner in the buffer portion 101 is not in the full state in the case where there is no image formation request from the controller after the image formation stop warning request is issued from the engine controller 120 to the controller will be described.

Figure 10A:
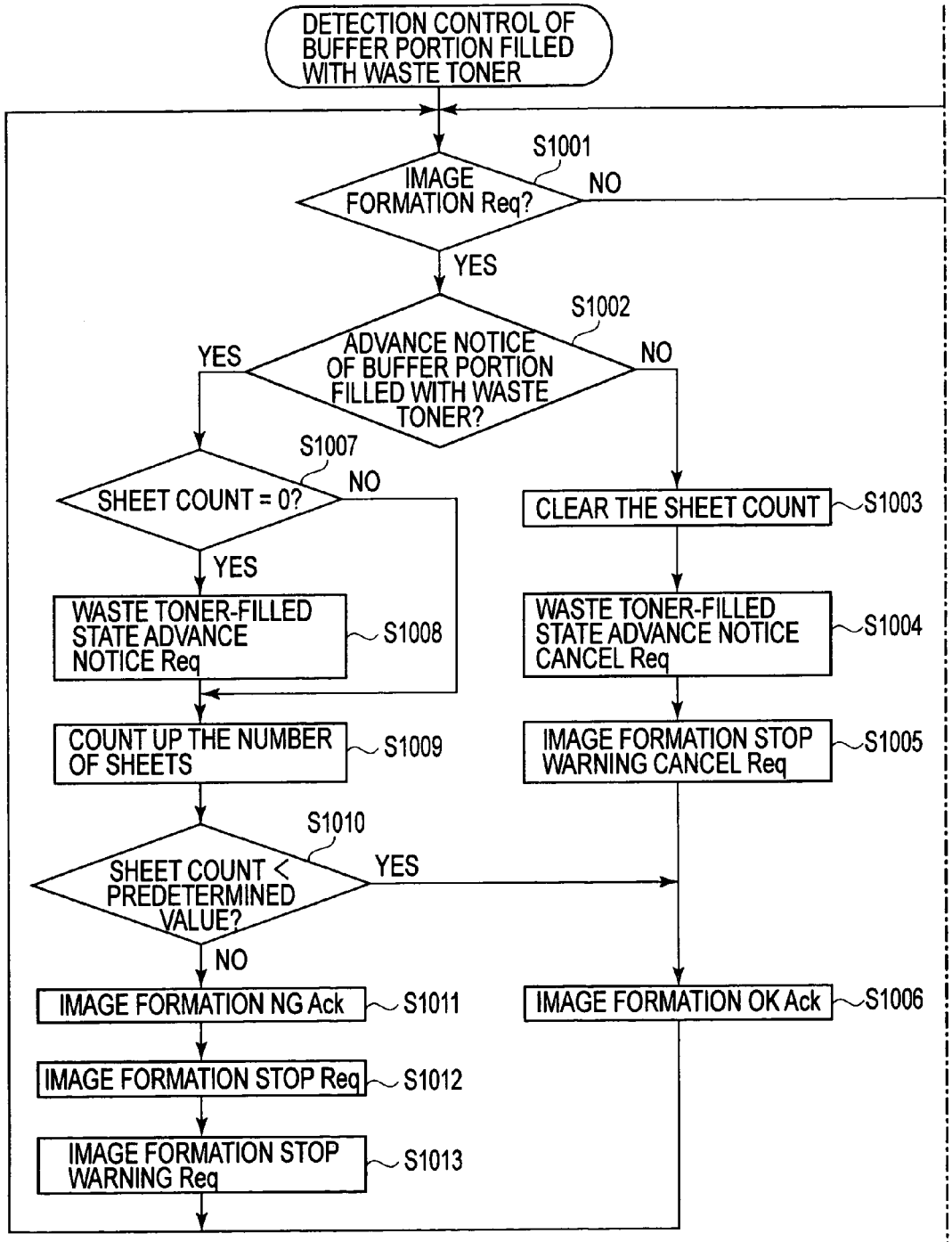
FIG. 10 (10A, 10B) is a flowchart showing detection control of buffer portion filled with waste toner in a modified embodiment of Embodiment 3.
Figure 10B:
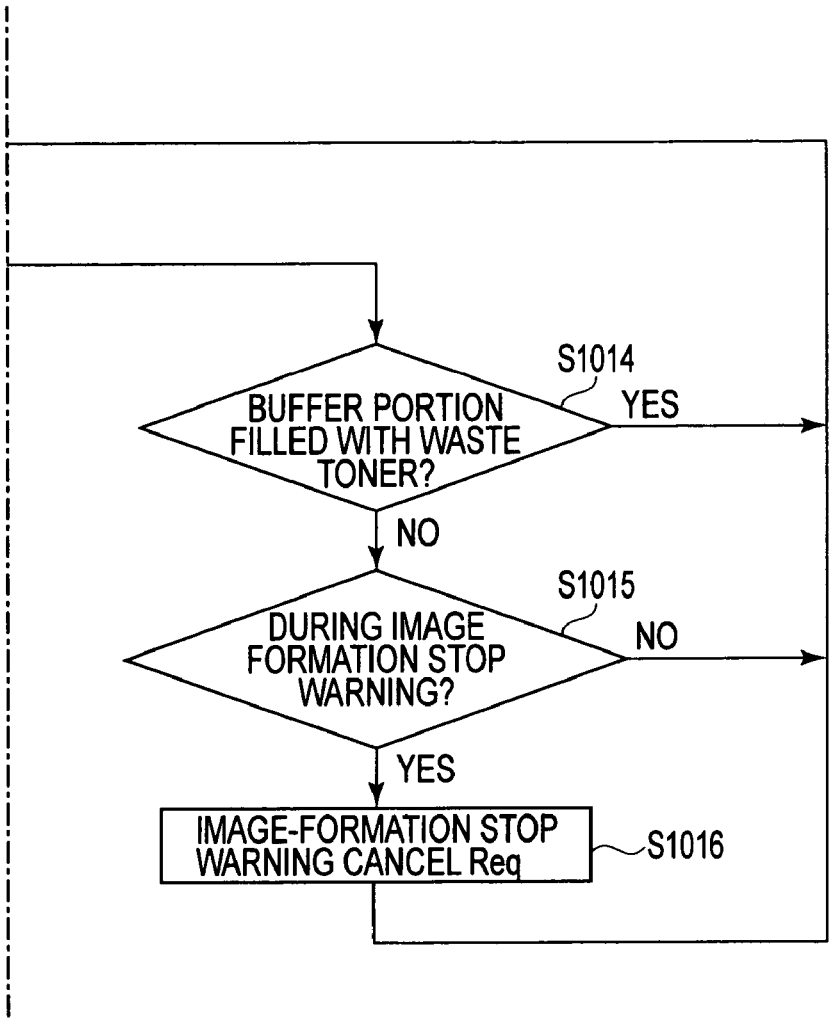
Figure 10:
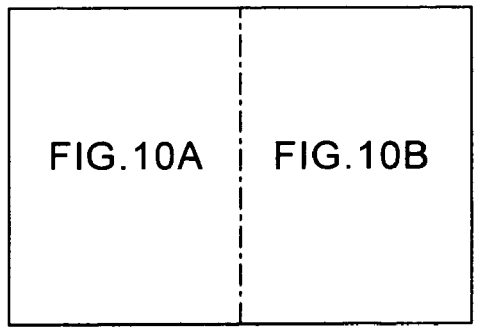

FIG. 10 is a flowchart showing detection control of the buffer portion filled with waste toner in this modified embodiment. Steps S1001 to S1013 shown in FIG. 10 are identical to the steps S701 to S713, so that hereinbelow, only different steps will be described.

In a step S1001, a determination is made as to whether or not an image formation request from the controller is made. When the image formation request is not made, the control goes to a step S1014 in which a determination is made as to whether the buffer portion 101 is filled or not with the waste toner on the basis of a signal from the buffer portion waste toner full state detection sensor 105 for the buffer portion 101. When the signal indicates the full state, the control is returned to the step S1001 but when it does not indicates the full state, the control goes to a step S1015 in which a determination as to whether or not an image formation stop warning request has already been issued is made. When the image formation stop warning request is not issued, the control is returned to the step S1001 but when it has already been issued and the warning is currently displayed at the display portion, the control goes to a step S1016 in which an image formation stop warning cancel request to the controller is made in order to cancel the image formation stop warning, and is returned to the step S1001.

As described above, according to Embodiment 3, in addition to the effects attained in Embodiment 2, it is further possible to display the waste toner full state advance notification warning and the image formation stop warning in the case where the waste toner in the buffer portion 101 is first placed in a state close to the full state. Further, it is also possible to cancel the warning in the case where the waste toner is not placed in the state close to the full state.

(Embodiment 4)

In this embodiment, control of waste toner conveyance with use of the screw disposed inside the second waste toner pipe 104 by the engine controller 120 at the time of performing image formation or replacing the waste toner container 102 when the waste toner is placed in the full state, will be described. Incidentally, this control is performed in all Embodiments 1 to 3 but may be always performed irrespective of image formation.

Figure 11:
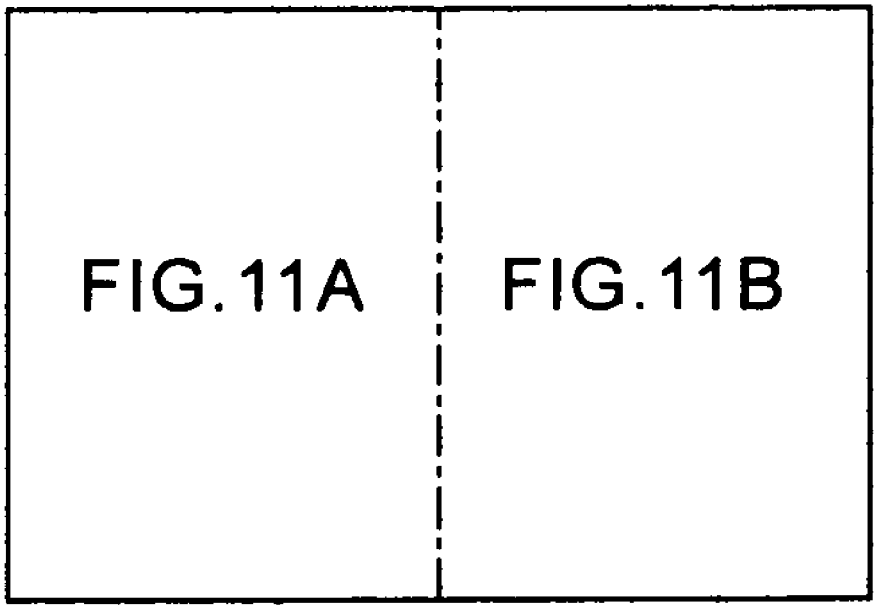
FIG. 11 (11A, 11B) is a flowchart showing waste toner conveyance control by a second waste toner pipe.
Figure 11A:
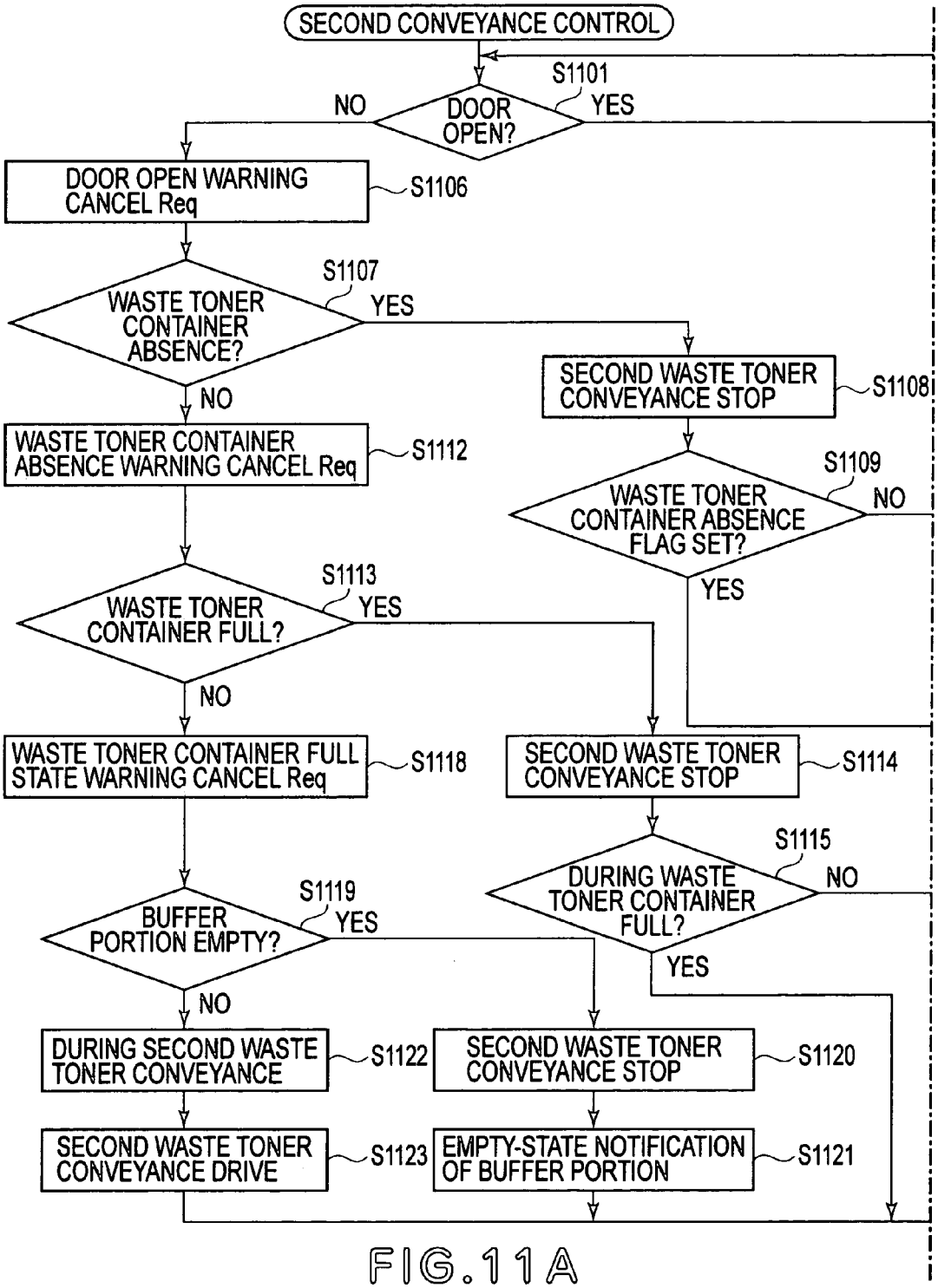
Figure 11B:
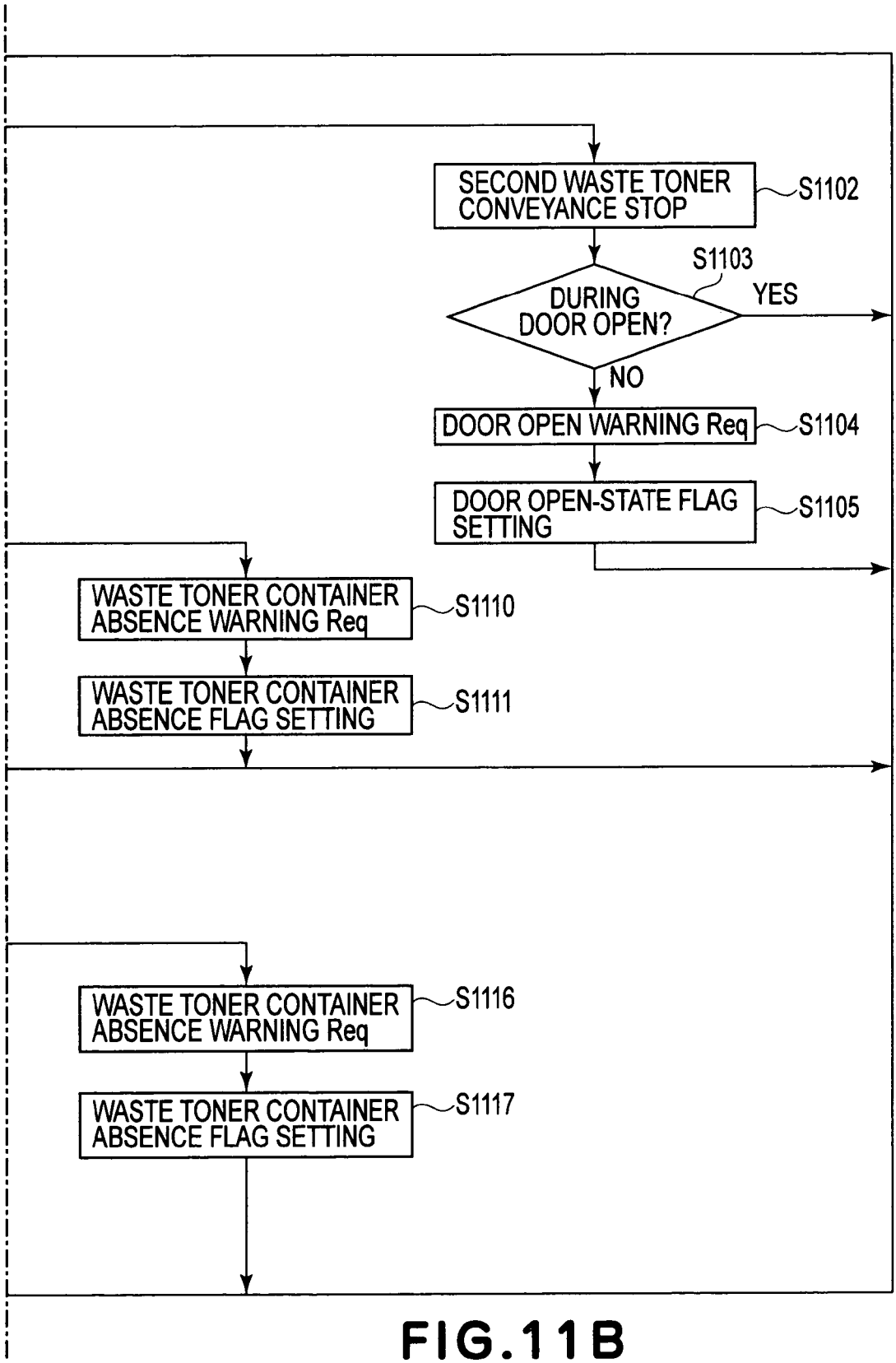

FIG. 11 is a flowchart showing the control of waste toner container by the second waste toner pipe 104 in this embodiment.

First, in step S1101, a determination of an open/close state of a door 110 is made on the basis of a signal from a door open/close sensor 109 of the apparatus main assembly. When the door 110 is opened, the control goes to a step S1102 in which the screw in the second waste toner pipe 104 is stopped to terminate conveyance of the waste toner from the buffer portion 101 to the waste toner container 102. In a step S1003, a determination as to whether the door 110 has already been placed in the open state or not is made by the presence of a flag indicating that the door 110 is in the open state. When the door 110 is in the open state (i.e., the door open-state flag is set), the control is returned to the step S1101 and when the door open-state flag is not set, the control goes to a step S1104 in which such a warning request that the door 110 is in the open state (door open warning request) is issued to the controller so as to remove the waste toner container 102. Then, in a step S1105, the above described door open-state flag is set, and the control is returned to the step S1101.

Incidentally, the door open-state flag is reset in an initial state and reset when a signal from the door open/close sensor 109 indicates a close state.

On the other hand, in the step S1101, when the door is closed, the control goes to a step S1106 in which a cancel request of the above described door open warning is issued to the controller. Next, in Step S1107, on the basis of a signal from a waste toner container presence/absence detection sensor 108, a determination of presence or absence of the waste toner container 102 is made. When the waste toner container 102 is absent, the control goes to a step S1108 in which conveyance of the waste toner is stopped similarly as in the step S1102. Then, in a step S1109, a determination as to whether or not the waste toner container 102 has already been removed to be placed in an absence state is made by the presence of a waste toner container absence flag. When the waste toner container absence flag is set, the control is returned to the step S1101 and when it is not set, the control goes to a step S1110 in which a request of a warning indicating the absence of the waste toner container is issued to the controller. Then, in a step S1111, the above described waste toner container absence flag is set, and the control is returned to the step S1101.

Incidentally, the waste toner container absence flag is reset in an initial state and reset when the signal from the waste toner container presence/absence detection sensor 108 indicates the presence state.

Further, in the above described step S1107, when the waste toner container is present, the control goes to a step S1112 in which a cancel request of the above described waste toner container absence warning is issued to the controller. Next, in Step S1113, on the basis of a signal from a waste toner container full state detection sensor 107, a determination as to whether the waste toner in the waste toner container 102 is filled or not with the waste toner is made. When the waste toner container 102 is filled with the waste toner, the control goes to a step S1114 in which conveyance of the waste toner to the waste toner container is stopped similarly as in the step S1102. Then, in a step S1115, a determination as to whether or not the waste toner container 102 is filled with the waste toner is made by the presence of a waste toner container full state flag. When the waste toner container full state flag is set, the control is returned to the step S1101 and when it is not set, the control goes to a step S1116 in which a request of a warning indicating the full state of the waste toner container is issued to the controller. Then, in a step S1117, the above described waste toner container full state flag is set, and the control is returned to the step S1101.

Incidentally, the waste toner container full state flag is reset in an initial state and reset when the signal from the waste toner container presence/absence detection sensor 108 indicates the presence state and the signal from the waste toner container full state detection sensor 107 does not indicates the full state.

On the other hand, in the above described step S1113, when the waste toner container 102 is not filled with the waste toner, the control goes to a step S1118 in which a cancel request of the above described waste toner container full state warning is issued to the controller. Next, in Step S1119, on the basis of a signal from a buffer portion waste toner empty detection sensor 106, a determination as to whether the waste toner in the buffer portion 101 is present or not with the waste toner is made. When the waste toner container 102 is empty, the control goes to a step S1120 in which conveyance of the waste toner to the waste toner container 102 is stopped similarly as in the step S1102. Then, in a step S1121, a notification of absence of the waste toner in the buffer portion 101 is provided to the controller, and the control is returned to the step S1101. When there is the waste toner in the buffer portion 101, the control goes to a step S1122 in which a notification that the waste toner is currently conveyed by the second waste toner pipe 104, is provided to the controller. In a subsequent step S1123, the screw in the second waste toner pipe 104 is driven to start conveyance of the waste toner from the buffer portion 101 to the waste toner container 102, and the control is returned to the step S1101.

As described above, according to Embodiments 4, it is possible to prevent overflow of the waste toner from the waste toner container 102.

(Embodiment 5)

In this embodiment, specific arrangement examples of the buffer portion 101, the waste toner container 102, the first waste toner pipe 103, and the second waste toner container 104, and a replacement operation of the waste toner container 102 will be described.

Figure 12:
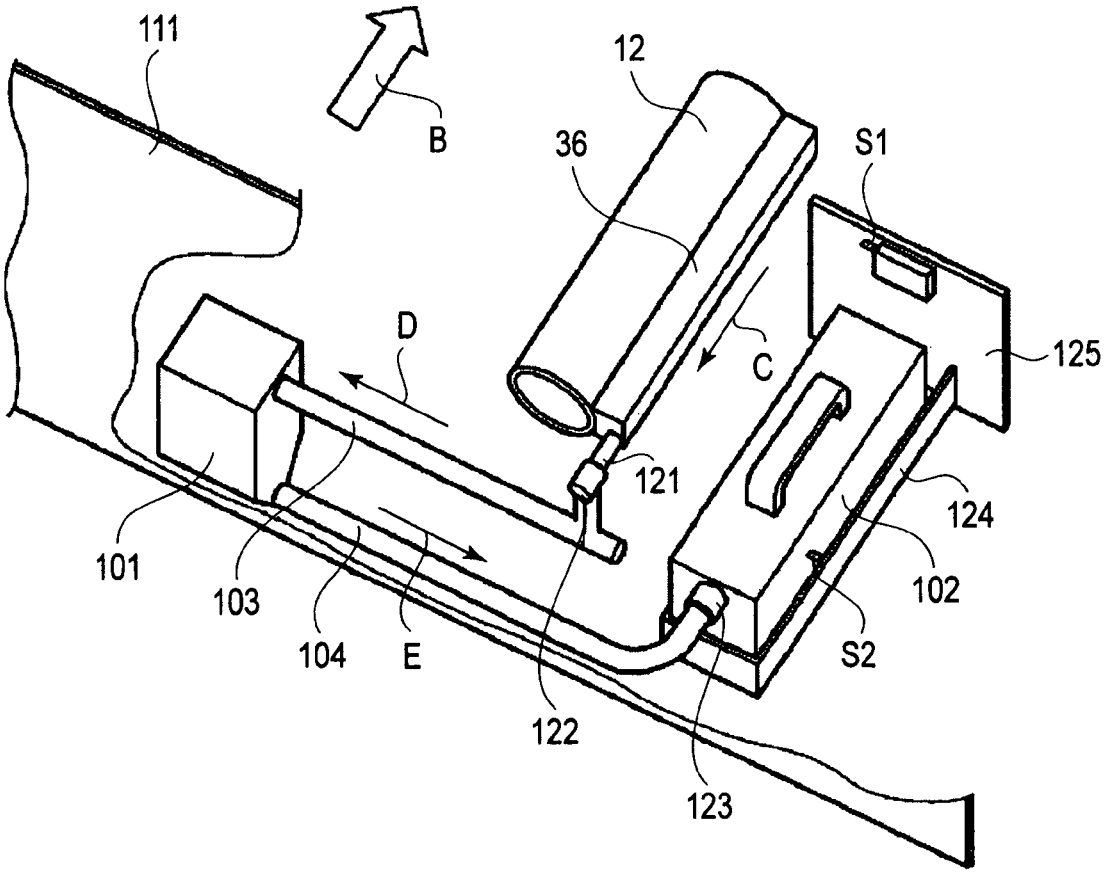
FIG. 12 is a perspective view showing a specific constitution of a waste toner conveyance path from a cleaner to a waste toner container.

FIG. 12 is a perspective view showing a specific constitution of a waste toner conveyance path from the cleaner to the waste toner container 102.

As shown in FIG. 12, on a front side (in a direction of an arrow B) of a side frame plate 111 of the apparatus main assembly, the cleaner 36 and the waste toner container 102 are disposed. On a rear side of the side frame plate 111, the buffer portion 101 for storing the waste toner, the first waste toner pipe 103 for conveying the waste toner recovered by the cleaner 36 to the buffer portion 101, and the second waste toner pipe 104 for conveying the waste toner from the buffer portion 101 to the waste toner container 102 are disposed at position in the waste toner conveyance path from the cleaner 36 to the waste toner container 102.

In this constitution, the waste toner recovered by the cleaner 36 is conveyed toward the rear side of the apparatus main assembly (in a direction of an arrow C) by an unshown conveyance means provided in the cleaner 36 and then is discharged out of the cleaner 36 through the discharge opening 121 extending toward the rear side of the side frame plate 111 of the apparatus main assembly.

The first waste toner pipe 103 has a connection portion 122 for connecting it with the discharge opening 121 of the cleaner 36 and receiving the waste toner, and conveys the waste toner received from the connection portion 122 to the buffer portion 101 by the screw (not shown) as a conveyance member. The second waste toner pipe 104 is connected with the buffer portion 101 at one end and is extended into the waste toner container 102 at the other end via a recovery opening 123 of the waste toner container 102, and conveys and discharges the waste toner from the buffer portion 101 to the waste toner container 102 by the screw (not shown) as the conveyance member.

Figure 13:
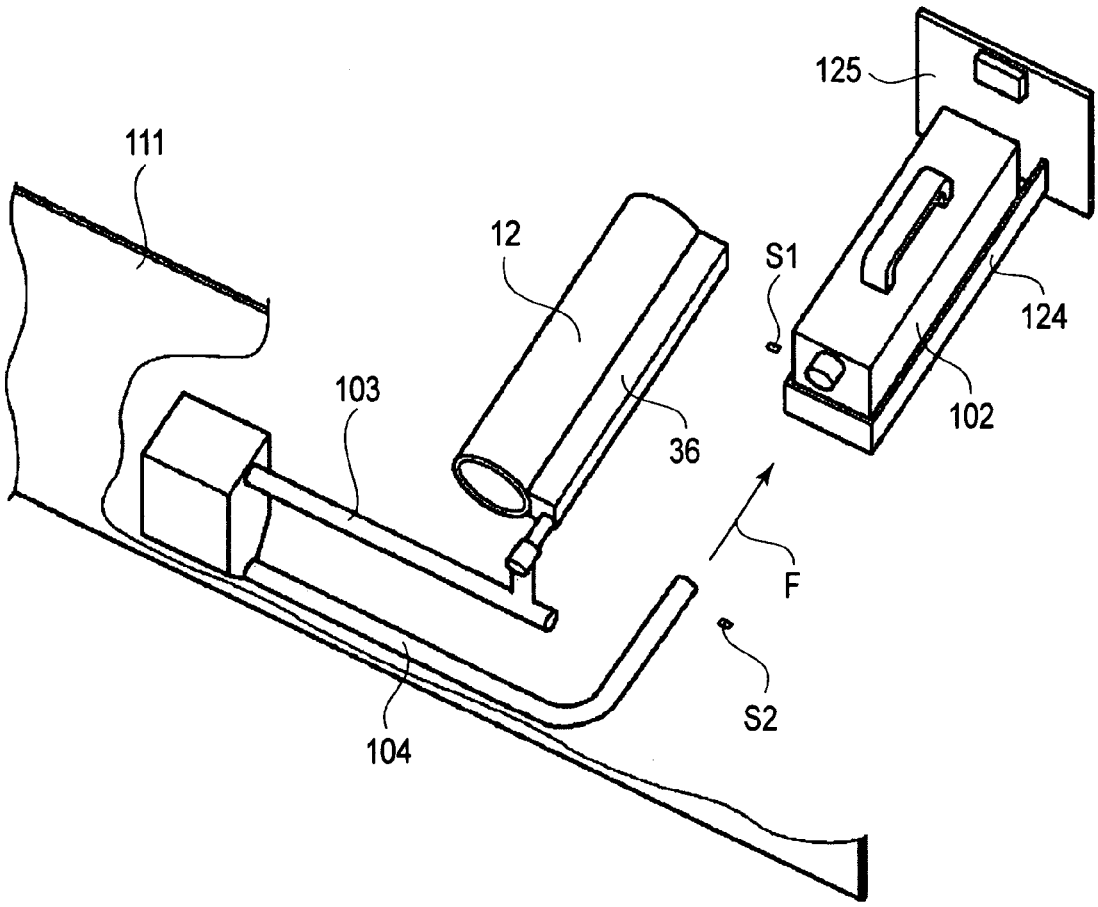
FIG. 13 is a perspective view showing such a state that a loading tray 124 is moved to a replacement position located in front of an apparatus main assembly (in an arrow F direction).
Figure 14:
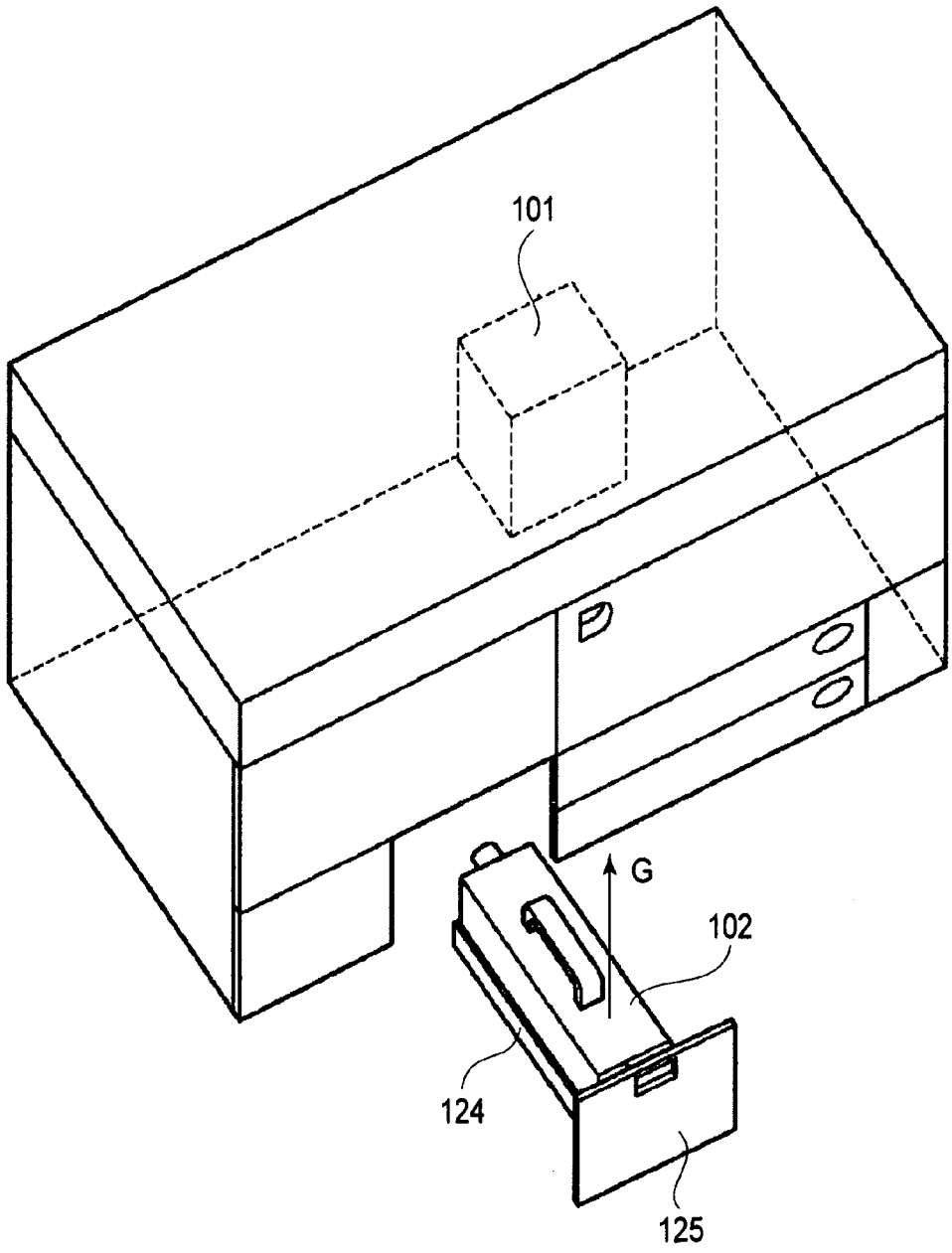
FIG. 14 is a perspective view for illustrating a replacement operation of a waste toner container 102.

On the other hand, the waste toner container 102 is mounted on the loading tray 124 is moved from a mounting position shown in FIG. 12 to a replacement position in front of the apparatus main assembly (in a direction of an arrow F) shown in FIG. 13, and then can be readily replaced by only a raising operation in an upward direction (in a direction of an arrow G) on the front side of the apparatus main assembly shown in FIG. 14.

Further, in Embodiment 5, in order to another mounting and demounting of the waste toner container 102 with respect to the apparatus main assembly, a loading tray open/close detection sensor S1 for detecting an open/close state of the loading tray 124 with respect to the apparatus main assembly and a waste toner container detection sensor S2 for detecting presence/absence of the waste toner container 102 at a mounting position of the loading tray 124 are employed.

Incidentally, the loading tray open/close detection sensor S1 corresponds to the door open/close detection sensor 109 described in Embodiments 1 to 4 with reference to FIG. 2, and the waste toner container detection sensor S2 corresponds to the waste toner container presence/absence detection sensor 108.

Figure 15:
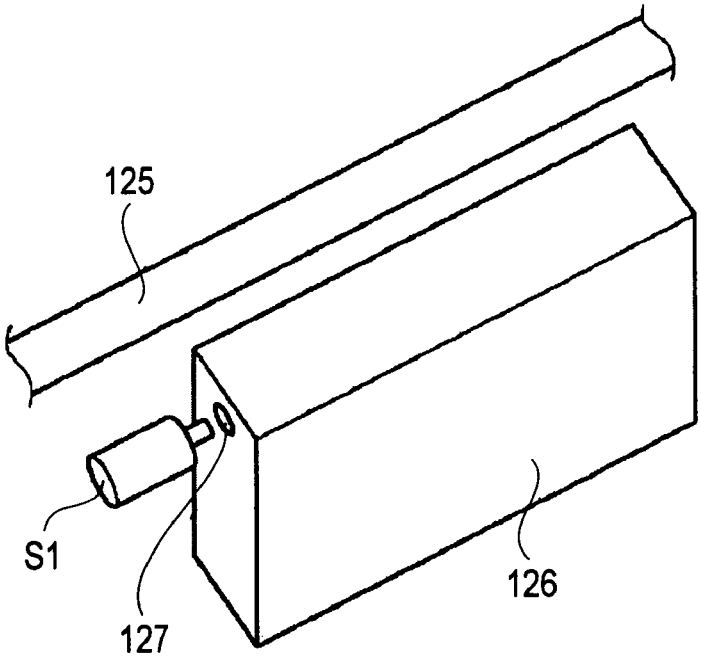
FIGS. 15(*a*) and (*b*) are views for illustrating a loading tray open/close detection sensor S1 and a detection state by the sensor S1, respectively.
Figure 15:
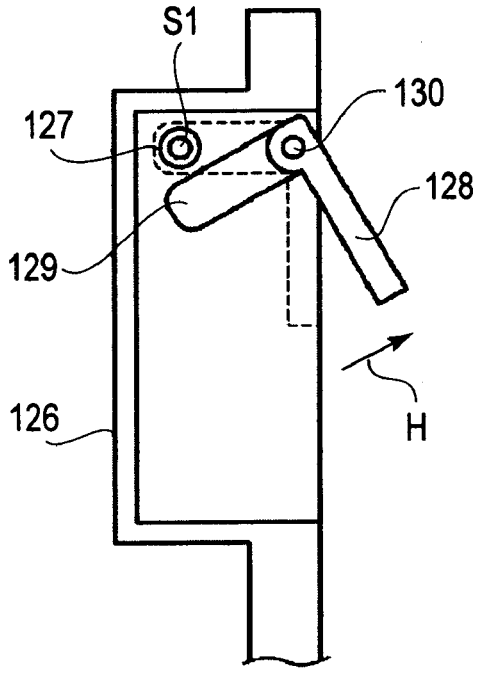

The loading tray open/close detection sensor S1, as shown in FIGS. 15 (*a*) and (*b*), detects presence/absence of a detection flag 129 of an open/close lever 128 through a detection hole 127 provided to an open/close portion 126 at an upper portion of a front cover 125 which is integrally formed with the loading tray 124, whereby the open/close state of the loading tray 124 is determined.

On the other hand, as shown in FIGS. 13 and 14, in such a state that the loading tray 124 is slided toward the front side of the apparatus main assembly to be opened, the loading tray open/close detection sensor S1 detects the detection flag 129 as being absent. Further, the open/close lever 128 has a locking mechanism (not shown) for fixing the loading tray 124 to the apparatus main assembly. When the loading tray 124 is slided toward the front side of the apparatus main assembly, as shown in FIG. 15(*b*), the open/close lever 128 supported around a rotation axis (shaft) 130 is rotationally moved in a direction of an arrow H, whereby the locking mechanism is released. At this time, the detection state of the loading tray open/close detection sensor S1 which has detected the presence/absence of the detection flag 129 is changed from the presence state to the absence state.

Accordingly, in the case of sliding the loading tray 124 toward the front side of the apparatus, it is possible to detect the sliding operation at the time of starting the operation.

Figure 16:
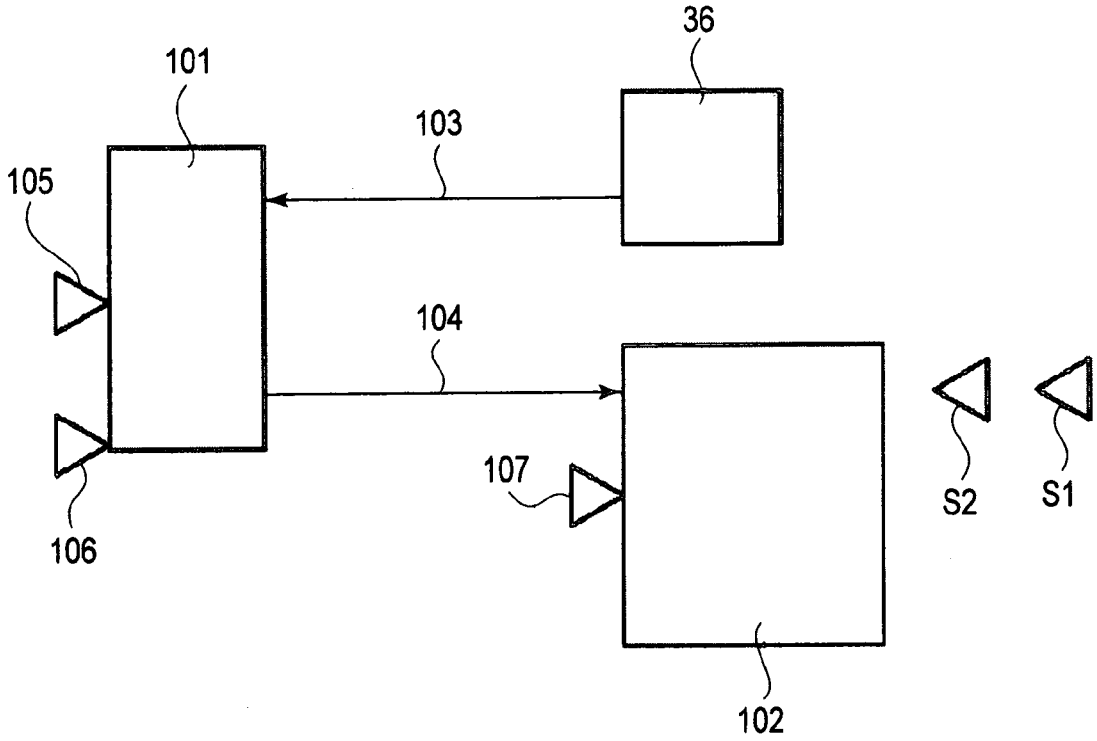
FIG. 16 is a schematic view showing a waste toner conveyance path and arrangement of respective sensors in Embodiment 5.

FIG. 16 is a schematic view showing a waste toner conveyance path and arrangement of respective sensors in Embodiment 5, and FIG. 17 is a table showing output logic of detection signals from the respective sensors.

In the above described constitution, similarly as in Embodiments 1 to 4, also in Embodiment 5, the engine controller 120 controls image formation and conveyance of waste toner by the first waste toner pipe 103 and the second waste toner pipe 104 on the basis of output logic from the respective sensors shown in FIG. 17.

As described above, according to Embodiment 5, the buffer portion 101 and the waste toner container 102 are disposed as shown in FIG. 12, and the waste toner container 102 is mounted on the waste toner container loading tray 124 which is slidably moved toward the front side of the apparatus main assembly in a horizontal direction, whereby it is possible to not only increase a degree of freedom with respect to arrangement of the buffer portion 101 and the waste toner container 102 but also improve operability at the time of replacing the waste toner container 102.

As described above, according to this embodiment, the engine controller 120 independently performs the waste toner conveyance control by use of the first waste toner pipe 103 and the waste toner conveyance control by use of the second waste toner pipe 104, so that it is possible to continue the waste toner conveyance operation of the first waste toner pipe 103 until the buffer portion waste toner full state detection sensor 105 detects the full state of the waste toner accumulated in the buffer portion 101 even when the waste toner conveyance operation of the second waste toner pipe 104 is stopped in the case of replacing the waste toner container 102 or in the case where the waste toner container full state detection sensor 107 has detected the full state of the waste toner recovered by the waste toner container 102. At this time, it is also possible to display a waste toner volume of the waste toner container 102 and a waste toner volume of the buffer portion 101 by providing a waste toner container full state display portion and a buffer portion full state display portion in the operation panel. Further, it is possible to notify the user of an operational status of the image forming apparatus by displaying a message to the effect that it is possible to convey the waste toner to the buffer portion even when the waste toner is in the full state.

Thereafter, the waste toner container 102 is replaced and when the waste toner is placed in such a state that it can be conveyed into the waste toner container 102, the waste toner accumulated in the buffer portion 101 is conveyed to the waste toner container 102 by the second waste toner pipe 104. Also at this time, it is possible to display respective waste toner volumes of the waste toner container 102 and the buffer portion 101 by providing a waste toner container full state display portion and a buffer portion full state display portion in the operation panel. Further, it is possible to notify the user of an operational status of the image forming apparatus by displaying a message to the effect that the waste toner container is replaced and it is possible to convey the waste toner from the buffer portion to the waste toner container.

Here, the waste toner conveyance, through the second waste toner pipe 104, to the waste toner container 102 after being replaced is controlled on the basis of the detection results of the buffer portion waste toner full state detection sensor 105 and the buffer portion waste toner empty state detection sensor 106. More specifically, after the waste toner container 102 is replaced, when the detection results of the buffer portion waste toner full state detection sensor 105 is not less than a predetermined accumulation amount, a conveyance operation of the second waste toner pipe 104 is started. When the amount of waste toner accumulated in the buffer portion is zero or less than the predetermined accumulation amount, the control is made such that the conveyance operation of the waste toner pipe 104 is not started and is stopped at predetermined timing on the basis of the detection result of the buffer portion waste toner full state detection sensor 105 when the amount of waste toner accumulated in the buffer portion 101 is zero or less than the predetermined accumulation amount during the conveyance operation of the second waste toner pipe 104. As a result, it is possible to prevent overflow of the waste toner from the waste toner container 102.

Further, on the basis of detection result of the buffer portion waste toner full state detection sensor 105 for detecting the amount of waste toner accumulated in the buffer portion 101, image formation and the waste toner conveyance by the second waste toner pipe 104 are controlled, so that it is possible to prevent overflow of the waste toner from the cleaner 36 due to continuation of image formation operation as in the conventional image forming apparatus.

Further, on the basis of detection results of the detection sensor waste toner container S2 (waste toner container presence/absence detection sensor 108) and the loading tray open/close detection sensor S2 (door open/close detection sensor 109), the conveyance control of the second waste toner pipe 104 is effected, whereby it is possible to stop the conveyance operation of the second waste toner pipe 104 at the time of starting the sliding operation of the loading tray 124. As a result, at the time of replacing the waste toner container 102, the waste toner conveyance operation is not continued, after the waste toner container 102 is removed from the apparatus main assembly, due to delay of detection of movement of the waste toner container 102 or a time lag until the stop of conveyance operation. Accordingly, it is possible to prevent toner scattering in the image forming apparatus and improve safety of the operator.

Further, the waste toner container full state detection sensor 107 and the buffer portion waste toner full state detection sensor 105 detect not only the full state of waste toner in the waste toner container 102 and the buffer portion 101 but also the amount of waste toner in the waste toner container 102 and the buffer portion 101 while leaving a certain space with respect to the full amount for waste toner recovery. By using the latter detection and the sheet counter is combination, after the warning of waste toner full state is displayed, at desired time, it is possible to stop the image formation operation and the waste toner conveyance by the first waste toner pipe 103 and the second waste toner pipe 104.

On the other hand, on the basis of outputs from the above described sensors and a signal for controlling the image formation operation, timings of conveyance by the first waste toner pipe 103 and the waste toner pipe 104 are synchronized with the operation at the image forming portion where the waste toner is generated, whereby it becomes possible to perform an efficient waste toner conveyance and reduce power consumption.

Further, when the waste toner container 102 is replaced, the loading tray 124, on which the waste toner container 102 is mounted, is slided to the replacement position in front of the apparatus main assembly and then the waste toner container 102 is only raised upward to permit replacement. As a result, it is possible to prevent the waste toner from overflowing from an opening portion of the waste toner container, due to inclination of the waste toner container, to contaminate the inside and the periphery of the image forming apparatus.

Figure 18:
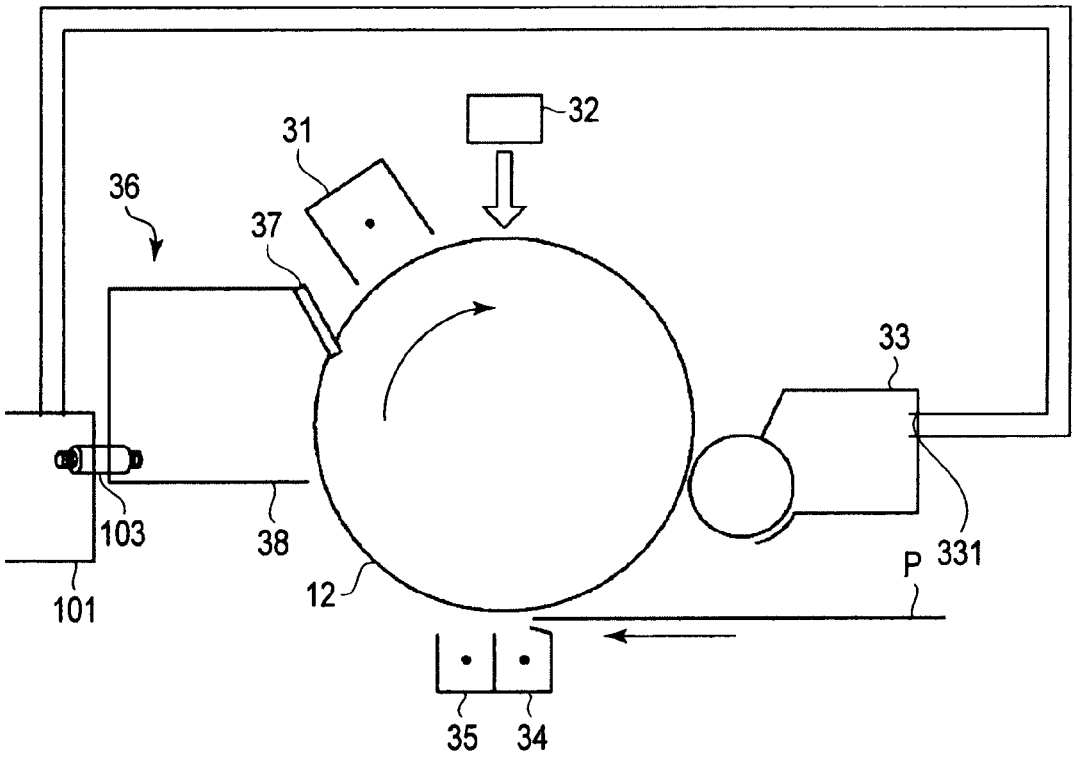
FIG. 18 is a schematic view showing a structure of such an image forming portion that waste toner is conveyed from a developing means to a waste toner container.

In Embodiments 1 to 5 described above, the buffer portion is disposed in the conveyance path from the cleaner container 38 to the waste toner container but may also be disposed in any manner within the scope of the present invention. For example, as shown in FIG. 18, the buffer portion may be disposed in a conveyance path from a toner discharge portion 331, provided to a developing means 33, to the waste toner container in such a constitution that toner which is unnecessary in the developing means 33 is recovered as the waste toner. Further, the present invention may also be similarly applicable to such a constitution that in an image forming apparatus wherein a toner image on a drum as an image bearing member is once transferred onto a transfer member such as an intermediary transfer member and then is further transferred from the intermediary transfer member to a recording material, transfer residual toner remaining on the intermediary transfer member is discharged from a cleaning means for cleaning the toner toward the waste toner container.

Further, in the embodiments described above, the buffer portion is disposed in the conveyance path between the cleaner container and the waste toner container but the present invention is not limited thereto but may also employ, e.g., such a constitution that two waste toner containers are provided so that the waste toner is dominantly conveyed into either one of the two waste toner containers, and when one of the two waste toner containers is filled with the waste toner, a conveyance path therefor is switched to the other waste toner container (buffer portion in this case), thus permitting successive conveyance of waste toner without stopping the image formation operation.

Further, in the above described embodiments, conveyance of waste toner to the buffer portion and the waste toner container is performed by the conveyance screw but the present invention is not limited thereto. For example, it is also possible to convey the waste toner to the buffer portion and the waste toner container by utilizing free fall by gravitation. In this case, as a means for stopping the waste toner conveyance, it is possible to use a shutter or the like by disposing it between the buffer portion and the waste toner container to terminate the conveyance of waste toner.

The image forming apparatus of the present invention may be applicable to a system comprising a plurality of equipment (e.g., a host computer, interface equipment, a reader, a printer, etc.) or an apparatus comprising single equipment (e.g., a copying machine, a facsimile apparatus, etc.).

Further, the object of the present invention can be achieved by supplying a recording medium, storing program codes of a software for realizing the functions described in the above embodiments, to a system or an apparatus and causing a computer (CPU or MPU) of the system or the apparatus to read and execute the program codes stored in the recording medium. In this case, the program codes per se read from the recording medium realize the above described functions in the embodiments of the present invention. Thus, the recording medium storing the program codes constitutes the present invention.

Examples of the recording medium for supplying the program codes may include floppy (trade name) disk, hard disk, optical disk, magneto-optical disk, CD-ROM, CD-R, magnetic tape, nonvolatile memory, ROM, etc.

The above described functions in the embodiments of the present invention can be realized by not only executing the program codes (read from the recording medium) by the computer but also executing all or a part of actual processing through an OS (operating system) running on the computer on the basis of instructions of the program codes.

Further, it is also possible to realize the functions in the above described embodiment in such a manner that the program codes read from the recording medium is written in a memory provided to a function-extended board incorporated in the computer or a function-extended unit connected to the computer, and then on the basis of instructions of the program codes, e.g., a CPU provided to the function-extended board or unit executes all or a part of actual processing.

While the invention has been described with reference to the structures disclosed herein, it is not confined to the details set forth and this application is intended to cover such modifications or changes as may come within the purposes of the improvements or the scope of the following claims.

This application claims priority from Japanese Patent Applications Nos. 021317/2004 filed Jan. 29, 2004 and 090058/2004 filed Mar. 25, 2004, which are hereby incorporated by reference.

What is claimed is:

1. An image forming apparatus, comprising:

image forming means, for forming an image on a recording medium with toner, having a discharge portion for permitting discharge of toner;

a first container capable of containing the toner conveyed from the discharge portion;

a second container removable from said image forming apparatus and capable of containing the toner conveyed from said first container;

stop means for stopping a conveyance of the toner from said first container to said second container;

toner amount detection means for detecting an amount of the toner contained in said first container; and determination means for determining an image forming operation on the basis of a detection result of said detection means when the conveyance of the toner from said first container to said second container is stopped, wherein when said second container is removed from said image forming apparatus, said image forming apparatus is capable of forming an image on the basis of a detection result of said toner amount detection means in a state in which the conveyance of the toner from said first container to said second container is stopped.

2. An apparatus according to claim 1, further comprising toner amount detection means for detecting an amount of the toner contained in said second container, and on the basis of a detection result of said toner amount detection means, when a detection that the amount of the toner in said second container reaches a predetermined amount is made, the conveyance of the toner to said second container is disabled.

3. An apparatus according to claim 1, further comprising first conveyance means for conveying the toner to said first container and second conveyance means for conveying the toner from said first container to said second container.

4. An apparatus according to claim 3, wherein said first conveyance means and said second conveyance means are independently controlled and a drive timing of said first conveyance means is different from a drive time of said second conveyance means.

5. An apparatus according to claim 3, wherein said detection means is capable of detecting a first detection level corresponding to a predetermined toner containment amount and a second detection level corresponding to a toner containment amount less than the predetermined toner containment amount, and on the basis of the detection of the first detection level by said toner amount detection means, image formation is stopped, and on the basis of a detection that the amount of the toner is not more than the second detection level, said second conveyance means is stopped.

6. An apparatus according to claim 3, wherein a conveyance ability of said second conveyance means is not less than a conveyance ability of said first conveyance means.

7. An apparatus according to claim 1, wherein said image forming means comprises developing means for developing a latent image on an image bearing member with toner, and said discharge portion is provided to said developing means.

8. An apparatus according to claim 1, wherein said image forming means comprises an image bearing member and cleaning means for cleaning toner on said image bearing member, and said discharge portion is provided to said cleaning means.

* * * * *

UNITED STATES PATENT AND TRADEMARK OFFICE

CERTIFICATE OF CORRECTION

PATENT NO. : 7,120,366 B2
APPLICATION NO. : 11/042169
DATED : October 10, 2006
INVENTOR(S) : Shinichi Onodera et al.

It is certified that error appears in the above-identified patent and that said Letters Patent is hereby corrected as shown below:

ON THE TITLE PAGE:
At Item (56), References Cited, Foreign Patent Documents, "JP 07271259 A * 10/1995" should read --JP 07-2712159 A * 10/1995--.

At Item (57), Abstract, Line 3, "and a waste toner container 102," should be deleted.
At Item (57), Abstract, Line 4, "capable of containing the waste toner" should be deleted.

IN THE DRAWINGS:
Sheet No. 7, Figure 8, "NOTECE?" (four occurrences) should read --NOTICE--.
Sheet No. 18, Figure 17, "SENSER" should read --SENSOR--.

COLUMN 1:
Line 49, "become" should read --becomes--.

COLUMN 2:
Line 7, "above described" should read --above-described--.
Line 23, "has" should read --has been--.
Line 24, "above described" should read --above-described--.
Line 35, "toner," should read --toner;--.
Line 37, "portion," should read --portion;--.
Line 39, "portion,' should read --portion;--.
Line 41, "container," should read --container;--.

COLUMN 3:
Line 60, "102 accumulates" should be deleted.
Line 61, "the waste toner 112 conveyed from the buffer portion" should be deleted.
Line 62, "is" should read --as--.

COLUMN 4:
Line 16, "drive" (first occurrence) should read --driven--.
Line 17, "The respectively," should read --Then respective--.
Line 33, "102" should read --107--.
Line 34, "becomes" should read --detects whether waste toner container 112 is--.

COLUMN 6:
Line 67, "(stopping" should read --(stepping--.

COLUMN 7:
Line 1, "motor)" should read --motor).--.
Line 14, "above described" should read --above-described--.

UNITED STATES PATENT AND TRADEMARK OFFICE

CERTIFICATE OF CORRECTION

PATENT NO. : 7,120,366 B2
APPLICATION NO. : 11/042169
DATED : October 10, 2006
INVENTOR(S) : Shinichi Onodera et al.

It is certified that error appears in the above-identified patent and that said Letters Patent is hereby corrected as shown below:

COLUMN 9:
Line 2, “sheet” should read --sheets--.
Line 3, “cleaned,” should read --cleared,--.
Line 8, “signal” should read --signal is--.
Line 16, “above described” should read --above-described--.
Line 20, “above described” should read --above-described--.

COLUMN 10:
Line 10, “a” (second occurrence) should read --an--.
Line 19, “above described” should read --above-described--.
Line 31, “above described” should read --above-described--.
Line 43, “to received” should read --is received--.
Line 46, “is not received it is received,” should read --is not received, the control is returned to step S801 but when it is received,--.
Line 59, “above described” should read --above-described--.

COLUMN 11:
Line 3, “to received” should read --is received--.
Line 5, “is not received” should be deleted.
Line 6, “it is received,” should read --is not received, the control is returned to step S901 but when it is received,--.
Line 15, “person” should read --person can--.

COLUMN 12:
Line 20, “above” should read --above- --.
Line 28, “above described” should read --above-described--.
Line 43, “above described” should read --above-described--.
Line 50, “above described” should read --above-described--.
Line 52, “above described” should read --above-described--.
Line 54, “Step” should read --step--.

COLUMN 13:
Line 2, “above described” should read --above-described--.
Line 10, “indicates” should read --indicate--.
Line 11, “above described” should read --above-described--.
Line 14, “above described” should read --above-described--.
Line 34, “Embodiments” should read --Embodiment--.

UNITED STATES PATENT AND TRADEMARK OFFICE

CERTIFICATE OF CORRECTION

PATENT NO. : 7,120,366 B2
APPLICATION NO. : 11/042169
DATED : October 10, 2006
INVENTOR(S) : Shinichi Onodera et al.

It is certified that error appears in the above-identified patent and that said Letters Patent is hereby corrected as shown below:

COLUMN 14:
Line 10, "is" should be deleted.
Line 18, "to another" should read --monitor--.
Line 41, "slided" should read --slid--.
Line 47, "slided" should read --slid--.
Line 64, "above described" should read --above-described--.

COLUMN 16:
Line 39, "is" (first occurrence) should read --in--.
Line 44, "above" should read --above- --.
Line 54, "slided" should read --slid--.

COLUMN 17:
Line 26, "above described" should read --above-described--.
Line 49, "above described" should read --above-described--.
Line 57, "above described" should read --above-described--.
Line 64, "above described" should read --above-described--.
Line 65, "is" should read --are--.

Signed and Sealed this

Fourteenth Day of August, 2007

JON W. DUDAS
*Director of the United States Patent and Trademark Office*